US010239672B2

(12) United States Patent
Perlman

(10) Patent No.: US 10,239,672 B2
(45) Date of Patent: Mar. 26, 2019

(54) DRIP-FREE GLASS BOTTLES HAVING A CIRCUMFERENTIAL CHANNEL AND METHODS OF MAKING AND USING SUCH BOTTLES

(71) Applicant: Brandeis University, Waltham, MA (US)

(72) Inventor: Daniel Perlman, Arlington, MA (US)

(73) Assignee: Brandeis University, Waltham, MA (US)

( * ) Notice: Subject to any disclaimer, the term of this patent is extended or adjusted under 35 U.S.C. 154(b) by 0 days.

(21) Appl. No.: 15/598,097

(22) Filed: May 17, 2017

(65) Prior Publication Data

US 2017/0334616 A1 Nov. 23, 2017

Related U.S. Application Data

(60) Provisional application No. 62/337,835, filed on May 17, 2016.

(51) Int. Cl.

| | |
|---|---|
| ***B65D 23/06*** | (2006.01) |
| ***B65D 47/40*** | (2006.01) |
| ***B65D 47/06*** | (2006.01) |

(52) U.S. Cl.

CPC ..... *B65D 47/40* (2013.01); *B65D 23/06* (2013.01); *B65D 47/06* (2013.01)

(58) Field of Classification Search

CPC ..... B65D 23/06; B65D 1/023; B65D 41/04; B65D 47/40

See application file for complete search history.

(56) References Cited

U.S. PATENT DOCUMENTS

| | | | | | |
|---|---|---|---|---|---|
| 1,124,743 | A | * | 1/1915 | Jackson et al. | B65D 23/06 215/331 |
| 2,025,406 | A | * | 12/1935 | Whelan | B65D 23/06 215/41 |
| 2,051,310 | A | * | 8/1936 | Millard | B65D 41/045 215/354 |
| 2,097,912 | A | | 11/1937 | Burnham | |
| 2,134,281 | A | * | 10/1938 | Illch | B65D 23/065 215/392 |
| 2,318,611 | A | * | 5/1943 | Jackson | B65D 23/06 215/41 |
| 2,708,049 | A | * | 5/1955 | Sokolik | B65D 23/06 215/340 |

(Continued)

OTHER PUBLICATIONS

PCT/US2017/033012, International Search Report and Written Opinion (dated Aug. 4, 2017).

(Continued)

*Primary Examiner* — Anthony D Stashick
*Assistant Examiner* — James R Way
(74) *Attorney, Agent, or Firm* — LeClairRyan PLLC

(57) ABSTRACT

Described herein is a glass bottle configured to improve the mechanics of liquid flow and prevent drip initiation. Additionally, the glass bottle eliminates dripping during pouring to enable drip-free pouring. The dripping is prevented over a full range of pouring angles, which vary depending on the amount of liquid held in the glass bottle. A method of making the glass bottle and a method of enabling drip-free pouring using the glass bottle are also disclosed.

27 Claims, 16 Drawing Sheets

(56) References Cited

U.S. PATENT DOCUMENTS

| | | | | |
|---|---|---|---|---|
| 5,383,565 | A * | 1/1995 | Luch | B65D 1/023 215/317 |
| 6,079,579 | A * | 6/2000 | De Cuyper | B65D 1/023 215/256 |
| 8,573,424 | B2 * | 11/2013 | Dubs | B65D 39/00 215/354 |
| 2003/0106873 | A1 * | 6/2003 | Grillo | B65D 1/023 215/41 |
| 2008/0230573 | A1 * | 9/2008 | Enahoro | B65D 1/023 222/571 |
| 2009/0294398 | A1 | 12/2009 | Fornes | |
| 2011/0011487 | A1 * | 1/2011 | Barnes | B65D 23/065 141/1 |
| 2014/0166607 | A1 | 6/2014 | Washizaki | |
| 2014/0332570 | A1 * | 11/2014 | Akutsu | B32B 5/16 428/34.1 |
| 2015/0197371 | A1 * | 7/2015 | Deckers | B65D 1/0207 215/12.2 |
| 2016/0137346 | A1 * | 5/2016 | Perlman | B65D 23/06 215/41 |

OTHER PUBLICATIONS

PCT/US2017/033012, International Preliminary Report on Patentability (dated Nov. 20, 2018).

* cited by examiner a. HEIGHT OF DOMED/CONVEX LIP
b. WIDTH OF FLOW GUIDE
c. WIDTH OF CHANNEL
d. WIDTH OF NECK COLLAR/SCREW THREAD ASSEMBLY e. DEPTH OF CHANNEL
f. DEPTH OF NECK COLLAR/SCREW THREAD ASSEMBLY g. HEIGHT OF A RADIUSED EDGE

DRIP-FREE GLASS BOTTLES HAVING A CIRCUMFERENTIAL CHANNEL AND METHODS OF MAKING AND USING SUCH BOTTLES

This application claims the benefit of U.S. Provisional Patent Application Ser. No. 62/337,835, filed May 17, 2016, which is hereby incorporated by reference in its entirety.

FIELD OF THE INVENTION

This technology generally relates to bottles and, more particularly, to drip-free glass bottles, methods of making such bottles, and methods of enabling drip-free pouring.

BACKGROUND

When wine is poured from a conventional glass wine bottle, any droplets of residual wine of sufficient size (and dependant upon the adhesion of the wine droplet to the glass bottle) around and beneath the lip of the bottle tend to drip down the outside of the neck and body of the bottle. The amount of unwanted "wine drip" depends on a variety of factors including the wine's viscosity and surface tension, the pouring angle of the bottle, the rate of pouring, the abruptness of ceasing the pouring, the glass surface properties, and the shape of the bottle. Dripped wine may stain a table surface or tablecloth onto which the bottle is placed.

Wine drip following pouring is evident with most, if not all, traditionally shaped glass wine bottles such as Bordeaux and Burgundy style wine bottles that are sealed with a cork plug closure. Stelvin-type threaded neck bottles with square-edged lips sealed with a screw cap are also susceptible to dripping, although the wine may be temporarily detoured through the bottle's threads. Some less common bottles containing effervescent wines and ciders as well as beer bottles have lips that differ markedly from traditional wine bottles, i.e., bead-shaped or protruding round lips, but these lips are also susceptible to the dripping problem.

As stated above, when wine is poured from the lip of a traditional glass wine bottle, a portion of the wine almost invariably drips down the outside of the bottle either during pouring or when the bottle is turned upright after pouring. Wine dripping is initiated when a stream of wine that is initially (and usually briefly) falling vertically from the lip of a wine bottle develops a hooked or "curled" flow. The orifice end of many traditional glass wine bottles is molded to form a somewhat curving or dome-shaped, or convex-outward end rather than either a flat or even a concave inward orifice end. Wine flowing over such a dome-shaped orifice end sometimes causes the exiting stream to assume the undesired curved flow over the end of the bottle, contributing to drip initiation. The curled flow tends to carry a small amount of the wine backward onto the underside of the bottle's neck and downward toward the heel of the bottle. As the bottle is tilted upright, any wine residing on the underside of the lip dribbles downward over the exterior of the bottle.

It has been found that a full or nearly full bottle of wine is more prone to the dripping problem than a nearly empty bottle. This observation is understood in terms of a changing tilt angle (i.e., angle of elevation of the neck) for a wine bottle being gradually emptied by a person controlling the rate of pouring. Elevation angles (abbreviated EA) for a bottle can be defined and measured from the tilt angle assumed by the "principal axis" of the bottle during pouring of wine from Bordeaux and Burgundy style wine bottles for example. The bottle's "principal axis" (aka, the "center axis") is defined by a line extending from the center of the heel of the bottle (the bottle's bottom), upward through the bottle's neck in the direction of wine flow.

FIG. 1A shows typical elevation angles for a Bordeaux style wine bottle that is substantially full of wine, i.e., between 80% and 100% of the bottle's liquid capacity remains in the bottle. The level of liquid in the bottles is indicated by a horizontal line. When a bottle is full, a person generally elevates the neck of the bottle relative to the heel of the bottle to regulate the flow of wine from the bottle's orifice. The angle of elevation (EA1) of the bottle measured for the principal axis of the bottle is generally about 15 degrees to provide for controlled pouring. Without such elevation, wine would flow too rapidly from the bottle. The upward tilt of a wine bottle during pouring, however, induces the exiting stream of wine to curve and curl backward onto the underside of the neck surface, initiating wine dripping down the neck of the bottle.

As shown in FIGS. 2A-B, for a full bottle of wine being poured with an upward tilt angle of approximately 15 degrees, a droplet of wine exiting the orifice of an unmodified bottle will run "downhill" along the underside of the lip. The dripping problem is only exacerbated after pouring, when the bottle is turned upright. Conversely, when a bottle is nearly empty, i.e. less than 20% of the bottle's liquid capacity remains in the bottle, as shown in FIG. 1B, the neck of the bottle is tilted downward approximately 10 degrees or more.

Droplets of wine on the lip or body of a bottle may not reach the table surface if an absorbent towel or napkin is wrapped around the neck of the bottle before pouring. This approach, however, requires cleaning of the towel or napkin or additional costs for disposable napkins. Alternatively, any of a variety of wine bottle pouring devices may be purchased and attached to a wine bottle and/or its neck opening to control the flow of wine from a bottle. For example, a variety of spouts may be inserted into the neck opening to regulate the flow of wine, aerate the wine, and/or prevent drips. One bottle claiming to be the world's first dripless wine bottle was produced in 1954 by the Roma Wine Company and incorporated a thin-edged plastic casing in the neck of the bottle. These solutions, however, all require additional inserts and do not provide for direct pouring from a glass bottle.

Alternatively, many containers used for holding and dispensing liquids have at least one feature to minimize drips, such as a spout that extends from the edge of the container outward to facilitate pouring and thereby prevent the last portion of a stream of liquid from running down the sidewall of a container. For example, a glass cream pitcher or a laboratory beaker may include an angled extension of the container's lip that functions as a dripless pouring spout, while a gable-top cardboard milk container may include a fold-out spout that is also dripless. Such a pouring spout on the lip of a wine bottle, however, would not be practical as a solution to the dripping problem given the method for sealing the bottle.

Unlike glass bottles, which tend to have hydrophilic surfaces, bottles made of plastic (e.g., PE, PET, PP) tend to be hydrophobic. Consequently, the capillary adhesion of aqueous liquids (e.g., wine) to glass bottles is markedly different from their adhesion to plastic bottles, which makes plastic bottles less susceptible to dripping. Plastic bottles can also be molded to include a sharp lip edge to further prevent dripping, which is not feasible with glass bottles, as sharp glass edges are prone to chipping and create a safety hazard.

The present technology is directed to overcoming these and other deficiencies in the art.

SUMMARY

A glass bottle is described herein having a neck comprising: a lip, a flow guide, a recessed circumferential channel, and an interior bore. The lip extends from an inner edge defining a substantially round bottle orifice to an outer edge, and forms a concentric ring around the bottle orifice. The flow guide extends downward from the outer edge of the lip and has an upper edge and a lower edge. The circumferential channel is located immediately below the flow guide, has an upper edge that defines the lower edge of the flow guide, and has a lower edge. The interior bore is substantially cylindrical from at least the region containing the circumferential channel upward to the inner edge of the lip. The glass bottle may further comprise an optional neck collar or screw thread assembly. The neck collar/screw thread assembly extends outward from the neck, forms a raised band or raised screw threads around the exterior surface of the neck, and is located below the circumferential channel. The lower edge of the circumferential channel is contiguous with or located no more than about 3 mm above the upper surface of the neck collar/screw thread assembly.

A method for enabling drip-free pouring includes providing a glass bottle having a neck. The neck comprises a lip, a flow guide, a recessed circumferential channel, and an interior bore. The lip extends from an inner edge defining a substantially round bottle orifice to an outer edge, where the lip forms a concentric ring around the bottle orifice. The flow guide extends downward from the outer edge of the lip and has an upper edge and a lower edge. The circumferential channel is located immediately below the flow guide, has an upper edge that defines the lower edge of the flow guide, and has a lower edge. The interior bore is substantially cylindrical from at least the region containing the circumferential channel upward to the inner edge of the lip. The glass bottle may further comprise an optional neck collar or screw thread assembly. The neck collar/screw thread assembly extends outward from the neck, forms a raised band or raised screw threads around the exterior surface of the neck, and is located below the circumferential channel. The lower edge of the circumferential channel is contiguous with or located no more than about 3 mm above the upper surface of the neck collar/screw thread assembly.

A method for making a drip-free glass bottle having a neck includes forming a lip at the upper end of the neck, forming a flow guide in an upper region of the neck, forming a recessed circumferential channel in an upper region of the neck, and forming an interior bore in the neck. The lip extends from an inner edge defining a substantially round bottle orifice to an outer edge, and forms a concentric ring around the bottle orifice. The flow guide extends downward from the outer edge of the lip and has an upper edge and a lower edge. The circumferential channel is located immediately below the flow guide, has an upper edge that defines the lower edge of the flow guide, and has a lower edge. The interior bore is substantially cylindrical from at least the region containing the circumferential channel upward to the inner edge of the lip. The method may further comprise forming an optional neck collar or screw thread assembly. The neck collar/screw thread assembly extends outward from the neck, forms a raised band or raised screw threads around the exterior surface of the neck, and is located below the circumferential channel. The lower edge of the circumferential channel is contiguous with or located no more than about 3 mm above the upper surface of the neck collar/screw thread assembly.

This technology relates to a glass bottle that is configured and arranged to improve the mechanics of liquid flow and prevent liquid from dripping down the side of the bottle, since few users appreciate a drip when pouring from a bottle. Additionally, this technology advantageously provides a bottle that eliminates dripping during and immediately following pouring. Further, this technology improves the mechanics of liquid flow from the bottle and limits the diameter of a single residual droplet of liquid that may cling to the flow guide immediately after pouring. Generally, the narrower the width of the glass band forming the flow guide, the smaller the single residual droplet. The dripping is prevented over a full range of pouring angles, which vary depending on the amount of liquid held in the bottle.

DETAILED DESCRIPTION

Figure 1A:
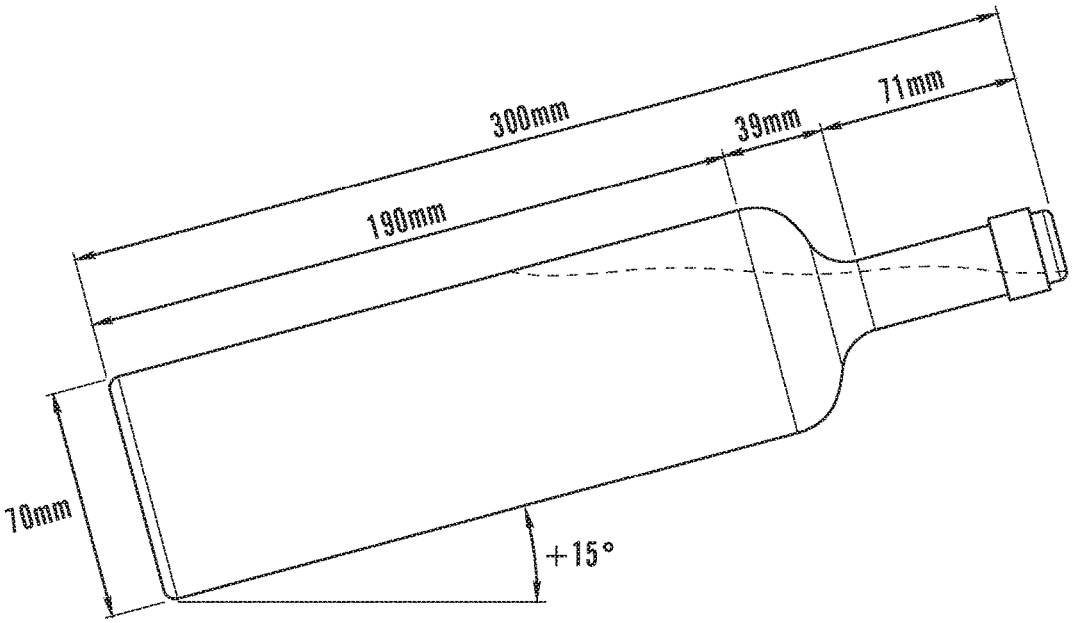
FIG. 1A PRIOR ART
FIG. 1A illustrates a typical elevation angle for a standard glass wine bottle that is substantially full of liquid while the liquid is being poured.
Figure 1B:
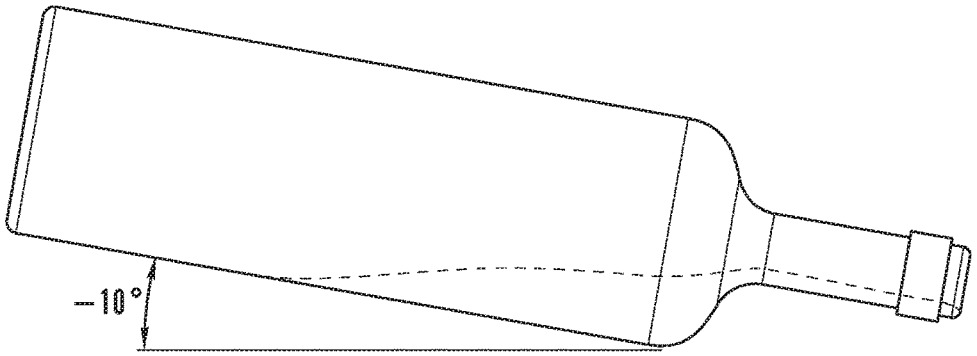
FIG. 1B PRIOR ART
FIG. 1B illustrates a typical elevation angle for a standard glass wine bottle that is nearly empty while the liquid is being poured.
Figure 2A:
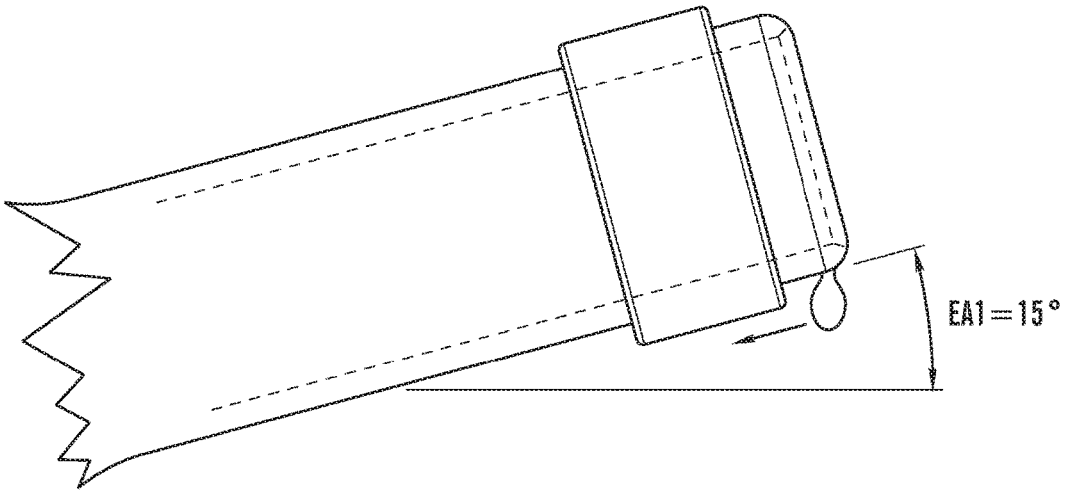
FIG. 2A PRIOR ART
FIG. 2A is a view of the neck portion of a typical Bordeaux or Burgundy style wine bottle in which the neck is oriented with a 15 degree angle of elevation generally used when pouring from a full bottle.
Figure 2B:
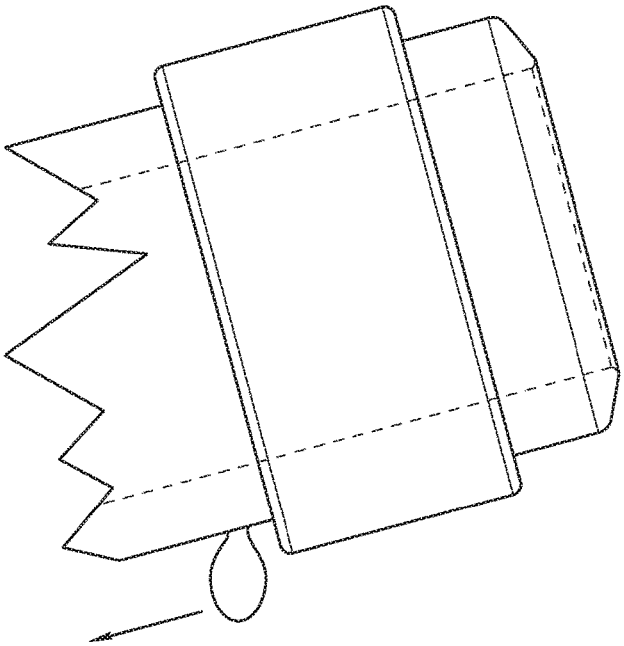
FIG. 2B PRIOR ART
FIG. 2B is a magnified view of a dome-shaped orifice end of a typical Bordeaux or Burgundy style wine bottle in which the neck is oriented with a 15 degree angle of elevation and in which a wine droplet is moving downward along the neck during or after pouring.

An example of a drip-free bottle 10 is illustrated in FIGS. 3-11. The bottle 10 includes a body 12, a shoulder 14, a neck 16, an optional neck collar (18*a*) or screw thread assembly (18*b*), a recessed circumferential channel 20, a flow guide 22, a lip 24, and an orifice 26, although bottle 10 may include other parts, elements, and/or features in other configurations. Bottle 10 is formed of glass (e.g., soda lime glass), although bottle 10 may be formed of other materials. Bottle 10 may be formed using known techniques for forming glass bottles, such as forming the glass bottle from a mold, glass fabrication, or glass blowing. In another embodiment, bottle 10 may be formed from an existing bottle using known techniques such as glass cutting, grinding, or etching, although other known techniques for forming glass bottles may be utilized. Although bottle 10 is shown as a wine bottle, it is to be understood that the exemplary technology of the present invention could be applied to other glass bottles for which drip-free pouring is desirable. This exemplary technology provides a number of advantages, including providing drip-free pouring over a range of pouring angles without the need for an additional bottle insert or the use of a napkin or other absorbent towel.

Other bottles for which drip-free pouring is desirable include, for example, port wine bottles, sherry wine bottles, Scotch whiskey bottles, and rum bottles. Bottles which include wine and spirits are particularly benefited by the present invention due to the presence of alcohol and dissolved sugar in wine and spirits, which decreases the surface tension of the liquid thereby exacerbating drip problems. Bottles for non-alcoholic liquids (e.g., olive oil, salad dressings, soy sauce, etc.) are also included within the scope of the present technology.

Figure 3:
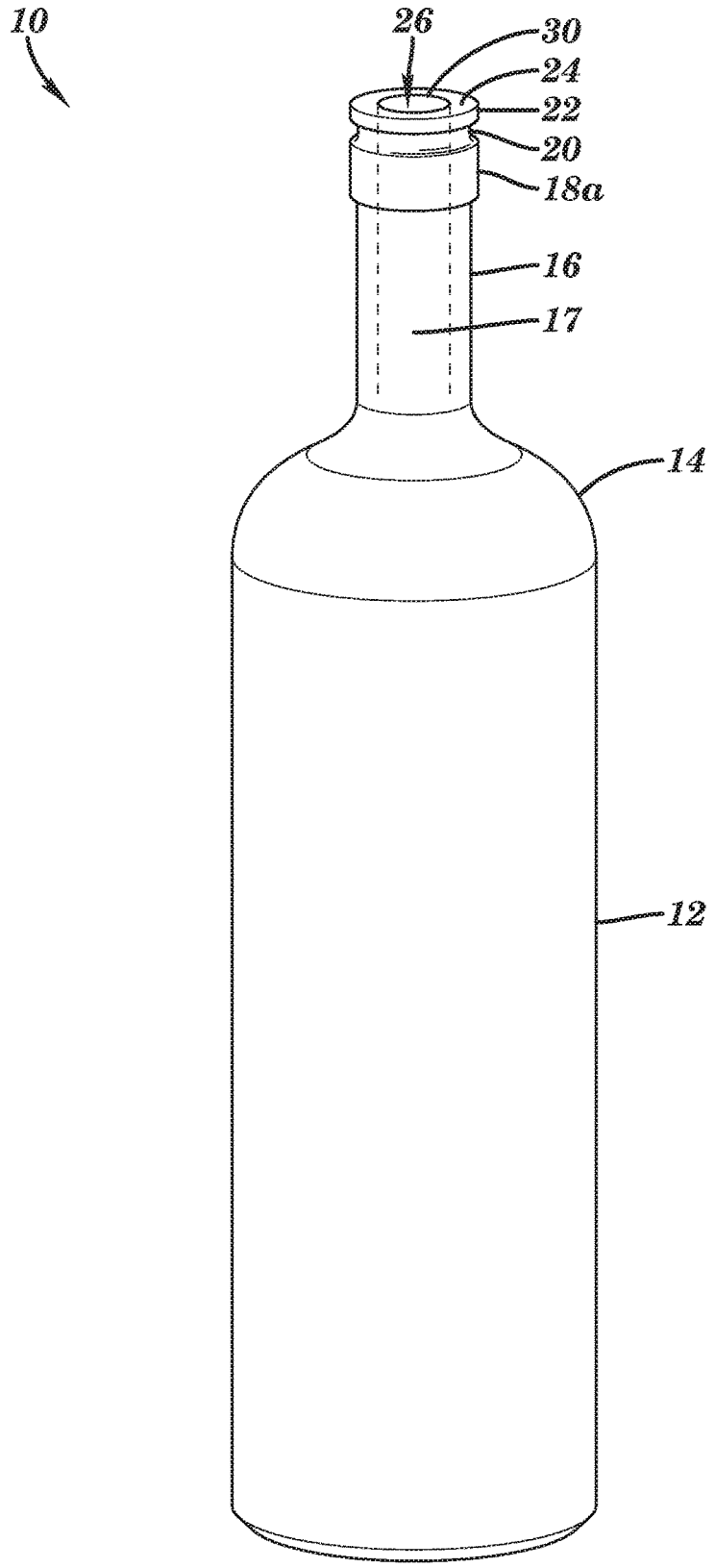
FIG. 3 is a perspective view of an exemplary drip-free bottle that has an optional neck collar.

Referring more specifically to FIG. 3, the body 12 is configured to house the majority of liquid stored within the bottle 10 and may be sized and shaped, by way of example, as a traditional 750 ml Bordeaux or Burgundy style wine bottle, although other sizes and shapes known in the art of bottle making may be utilized for the body 12. Bottles having larger capacities, such as 400 ml and above, are more susceptible to pouring problems that may be remedied by the present technology. The shoulder 14 provides a taper from the body 12 to the neck 16, although the shoulder 14 may have other configurations.

The exterior of neck 16 extends from shoulder 14 to the top of the lip 24. Wine bottles have an elongated neck typically approximately 2-4 inches long (e.g., approximately 2-3 inches long, approximately 3-4 inches long), as measured along the center axis of the bottle. In one embodiment, the neck is approximately 3 inches long. Other sizes and shapes known in the art of bottle making may also be used.

Referring more specifically to FIGS. 4A-C and FIG. 5, the neck 16 has an outer diameter of approximately 1.1-1.25 inches, although other diameters may be utilized for the neck 16. Neck 16 is configured with a smooth finished outer surface.

The interior of neck 16 extends from shoulder 14 to the inner edge 30 of lip 24. The interior surface of neck 16 forms a bore 17 extending from shoulder 14 to inner edge 30 of lip 24 for exiting wine or other fluid.

In one embodiment, the interior of neck 16 is sized to receive a friction-fitting plug style closure such as a cork plug for sealing that measures approximately 1¾ inches in length and ⅞ inch in diameter for a 750 ml capacity bottle, although other configurations for the neck 16 may be utilized. In such embodiments, the bore 17 is substantially cylindrical from the inner edge 30 of the lip 24 downward to the end of the region that will receive the closure, so that a cylindrical cork or other substantially cylindrical plug-type sealing device can substantially space-fill the neck of the bottle all the way up to its orifice end. This space-filling limits liquid residues, condensate, and molds that might otherwise grow in the space around or above the plug seal.

The circumferential channel 20 is located in the short length of the neck (2-6 mm cylindrical length) approximately 1-3.5 mm below the outer edge of the lip 24. Introduction of the channel 20 results in the formation of the flow guide 22 between the lip 24 and the channel 20. While other features may be present below the channel 20 (such as the optional neck collar/screw thread assembly), the lip 24, flow guide 22, and channel 20 are contiguous, respectively.

Figure 4A:
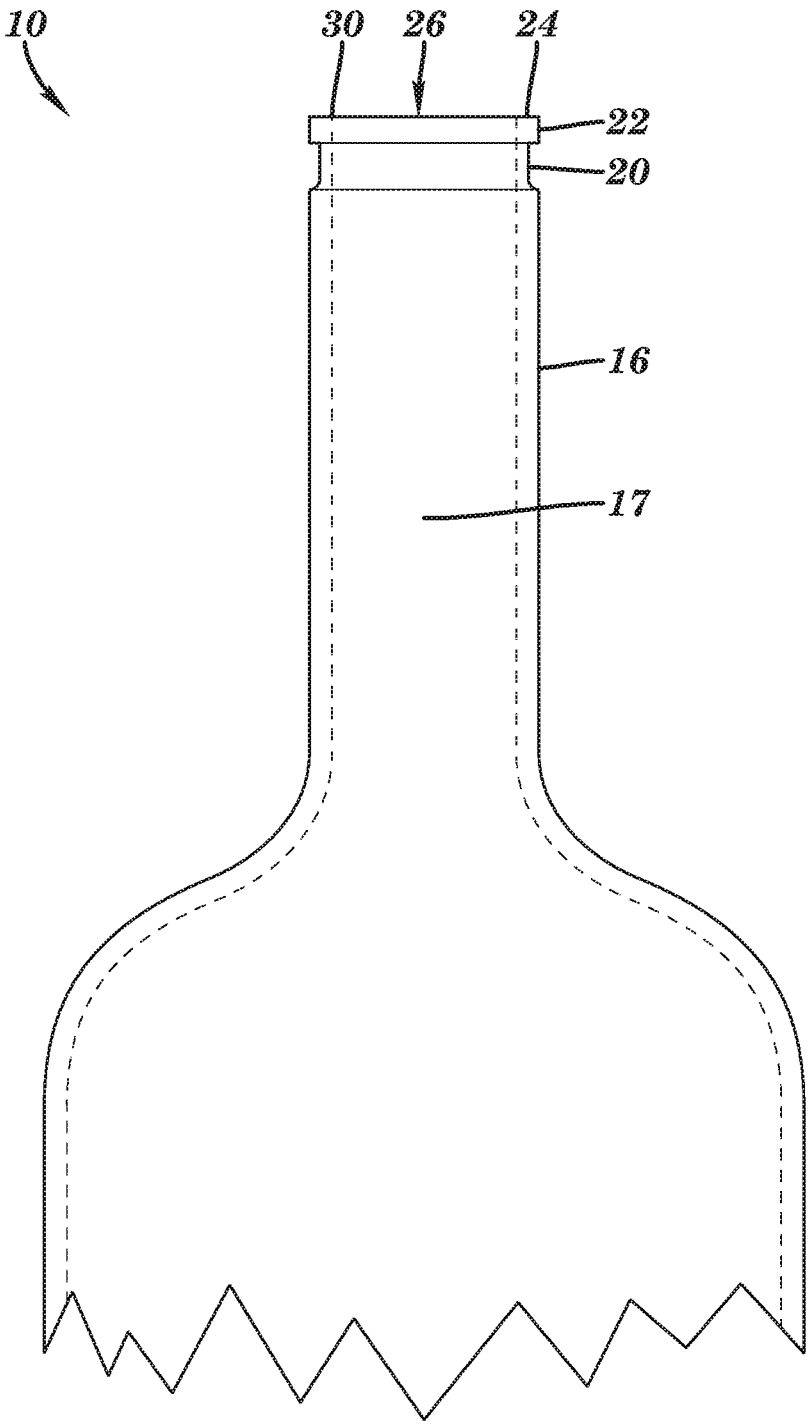
FIG. 4A is a side sectional view of the neck and shoulder portions of an exemplary drip-free bottle.

As shown in FIG. 4A, in one embodiment the neck contains only the lip 24, flow guide 22, and channel 20.

Figure 4B:
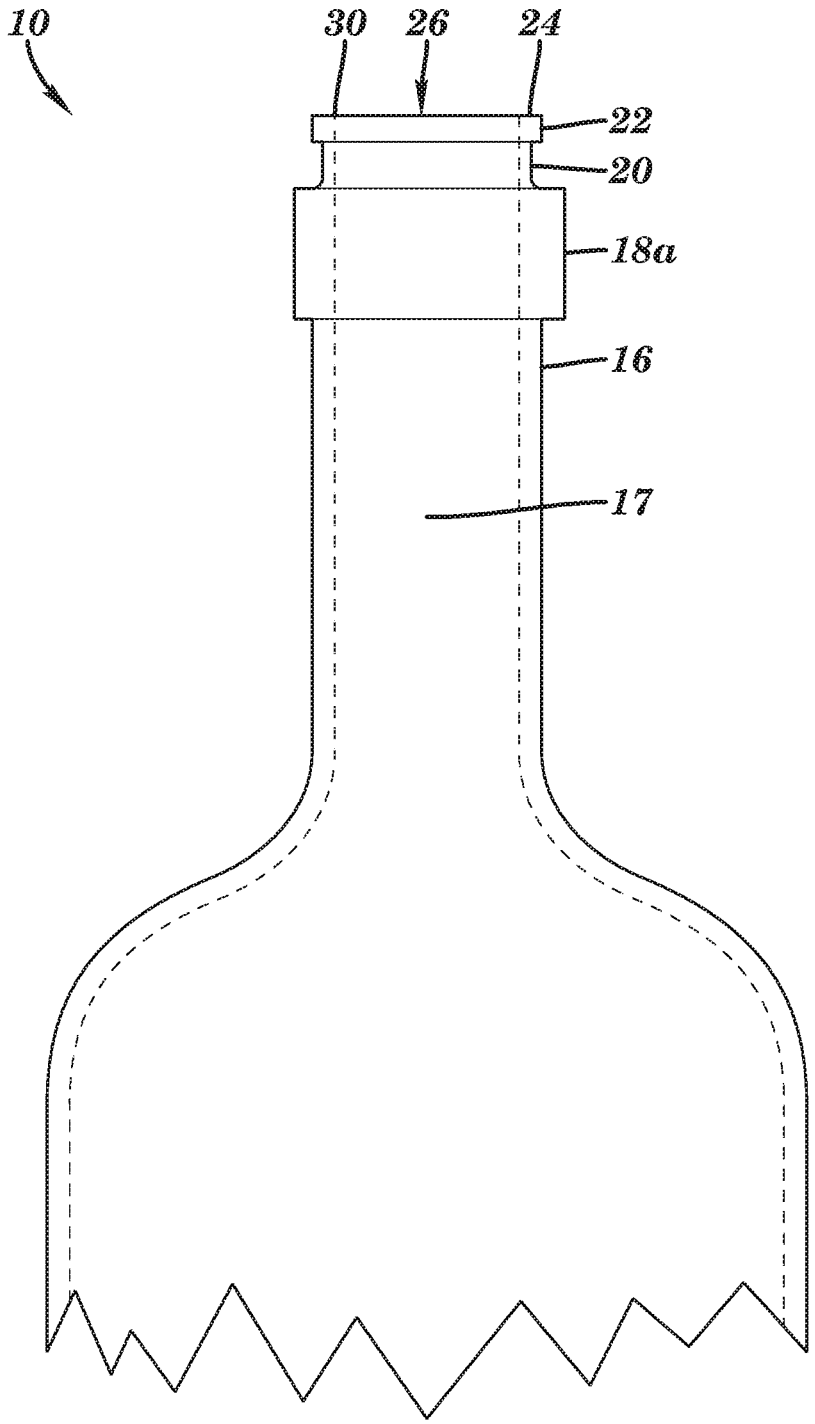
FIG. 4B is a side sectional view of the neck and shoulder portions of the drip-free bottle shown in FIG. 3, which has an optional neck collar.

As shown in FIG. 3 and FIG. 4B, in one embodiment the neck includes a neck collar 18*a*. The neck collar 18*a* is a smooth raised band of glass, integrally cast into the upper portion of neck 16 and extending around the exterior surface of the neck 16. The neck collar 18*a* is preferably about 0.5-2 cm (e.g., about 0.5-1.0 cm, about 0.5-1.5 cm, about 1.0-1.5 cm, about 1.0-2.0 cm, about 1.5-2.0 cm, about 0.5 cm, about 1.0 cm, about 1.5 cm, or about 2.0 cm, preferably about 1 cm) wide (measured from the upper edge of the neck collar to the lower edge of the neck collar along the center axis of the bottle) and typically stands in relief above the adjacent surface of the neck 16 approximately 1/16 inch, although neck collar 18*a* may have other widths and values for relief above the neck 16. The neck collar 18*a* is typically positioned such that the upper edge of the neck collar 18*a* is at least about 2 mm (e.g., at least about 3 mm, at least about 4 mm, at least about 5 mm, about 2-3 mm, about 2-4 mm, about 2-5 mm, about 2-6 mm, about 3-4 mm, about 3-5 mm, about 3-6 mm, about 4-5 mm, about 4-6 mm, about 5-6 mm, about 2 mm, about 3 mm, about 4 mm, about 5 mm, or about 6 mm, preferably about 3-6 mm) below the outer edge of lip 24 to ensure that an adequate buffer zone is provided between the lip 24 and the neck collar 18*a*. The neck collar 18*a* typically serves to strengthen the neck 16 and/or provide a strong bracing surface for receiving a lever-type, "sommelier knife" or "waiter's friend"-style corkscrew (e.g., a corkscrew in a folding body similar to a pocket knife). In such bottles, the bore 17 is substantially cylindrical from at least the region containing the neck collar 18*a* upward to the inner edge 30 of the lip 24.

Figure 4C:
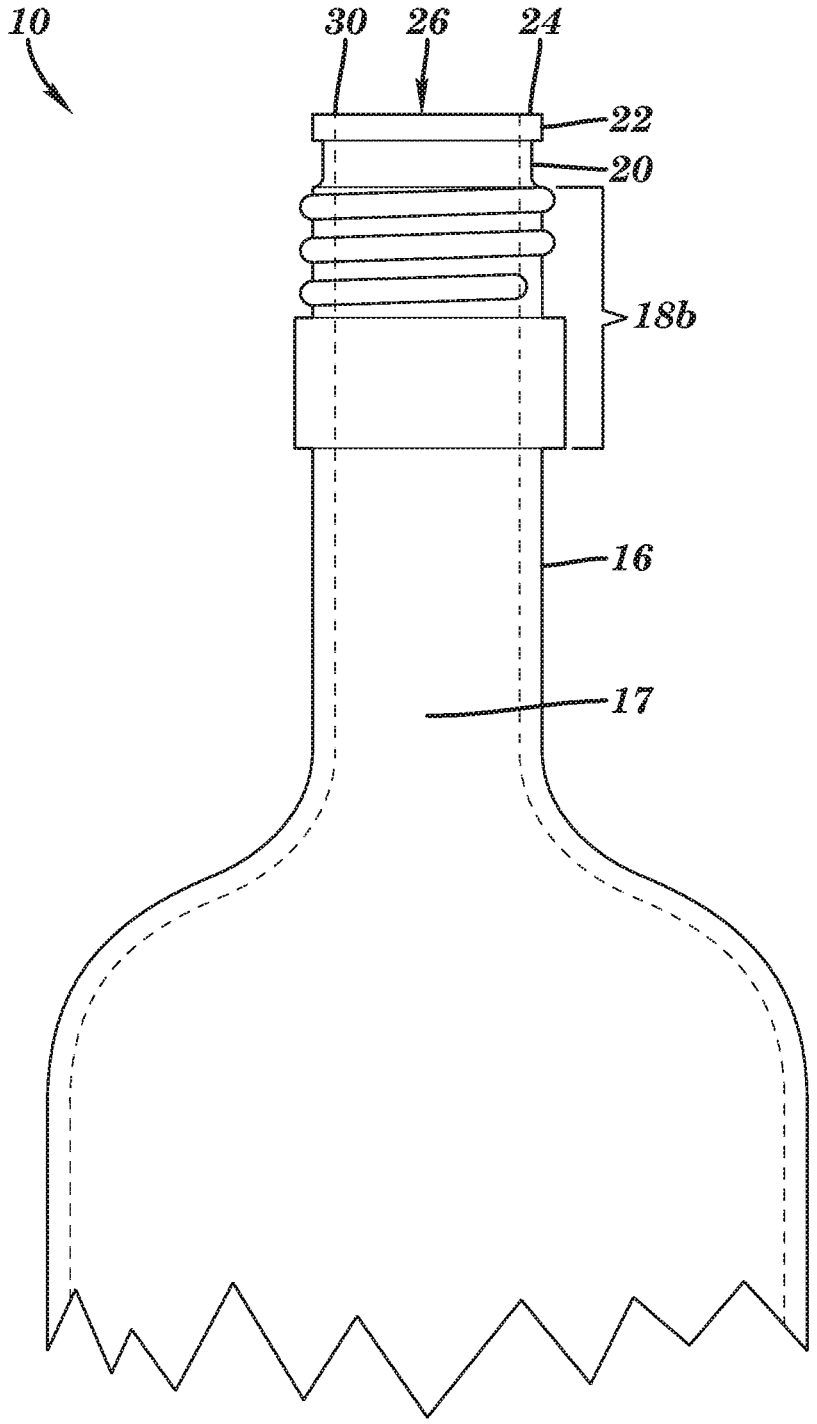
FIG. 4C is a side sectional view of the neck and shoulder portions of an exemplary drip-free bottle having an optional screw thread assembly.
Figure 5:
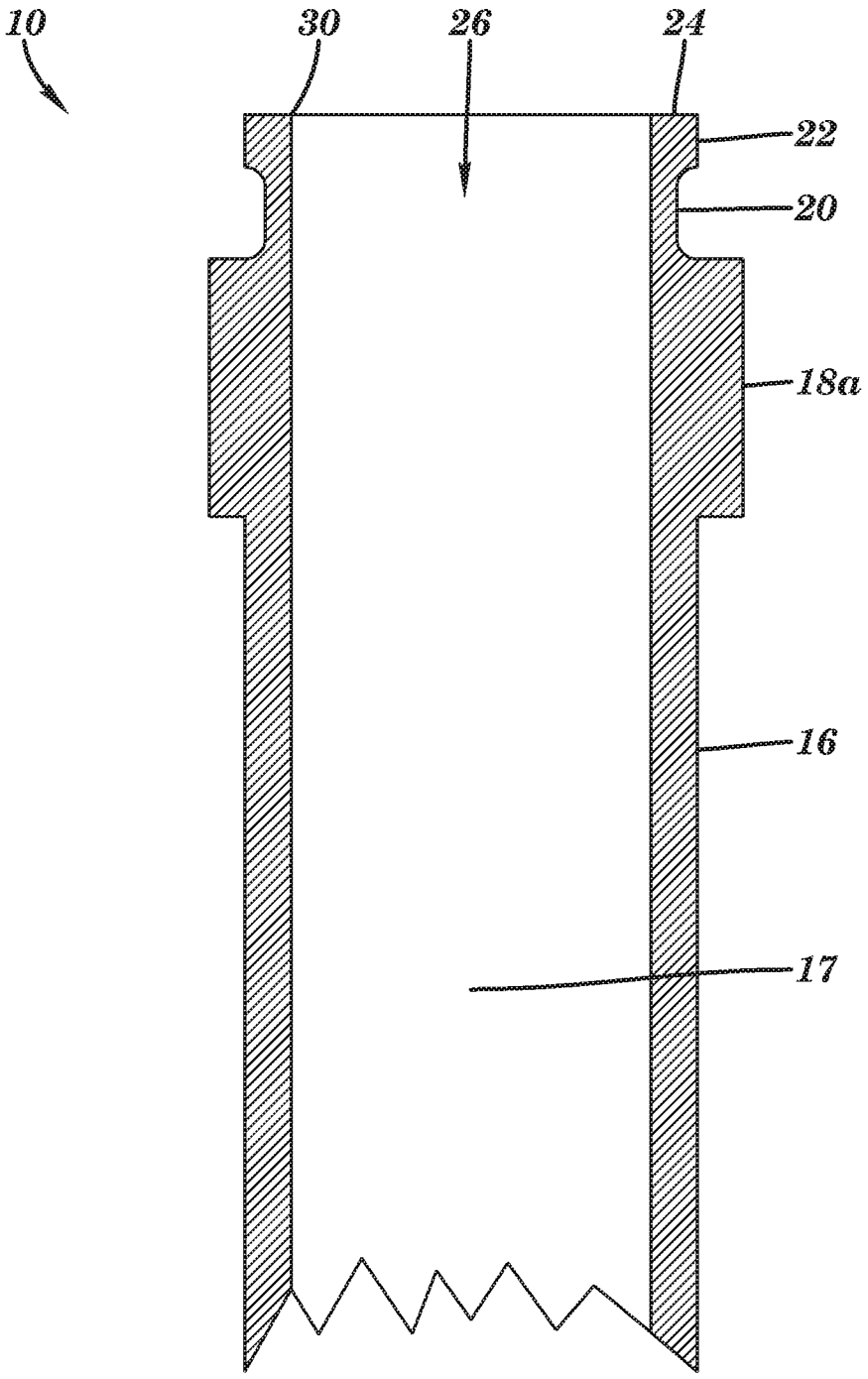
FIG. 5 is a side sectional view of the upper neck portion of the drip-free bottle shown in FIG. 3.

As shown in FIG. 4C, in one embodiment the neck includes a screw thread assembly 18*b* on its outer surface for receiving a screw cap (e.g., Stelvin-style) closure. The screw thread assembly includes one or more screw threads and, optionally, a raised band at the lower end of the screw thread assembly (shown in FIG. 4C) that can engage with the lower portion of the screw cap (e.g., for tamper-resistant break-away caps that are "locked" in place until they are unscrewed). Various screw thread assemblies are well known in the art. The screw thread assembly 18*b* is typically positioned such that the upper edge of the screw thread assembly 18*b* is at least about 2 mm (e.g., at least about 3 mm, at least about 4 mm, at least about 5 mm, about 2-3 mm, about 2-4 mm, about 2-5 mm, about 2-6 mm, about 3-4 mm, about 3-5 mm, about 3-6 mm, about 4-5 mm, about 4-6 mm, about 5-6 mm, about 2 mm, about 3 mm, about 4 mm, about 5 mm, or about 6 mm, preferably about 3-6 mm) below the outer edge of lip 24 to ensure that an adequate buffer zone is provided between the lip 24 and the screw thread assembly 18*b*.

As will be apparent to the skilled artisan, the neck could have both a screw thread assembly and a neck collar. In such embodiments, the screw threads would typically be positioned between the channel and the neck collar.

Figure 6A:
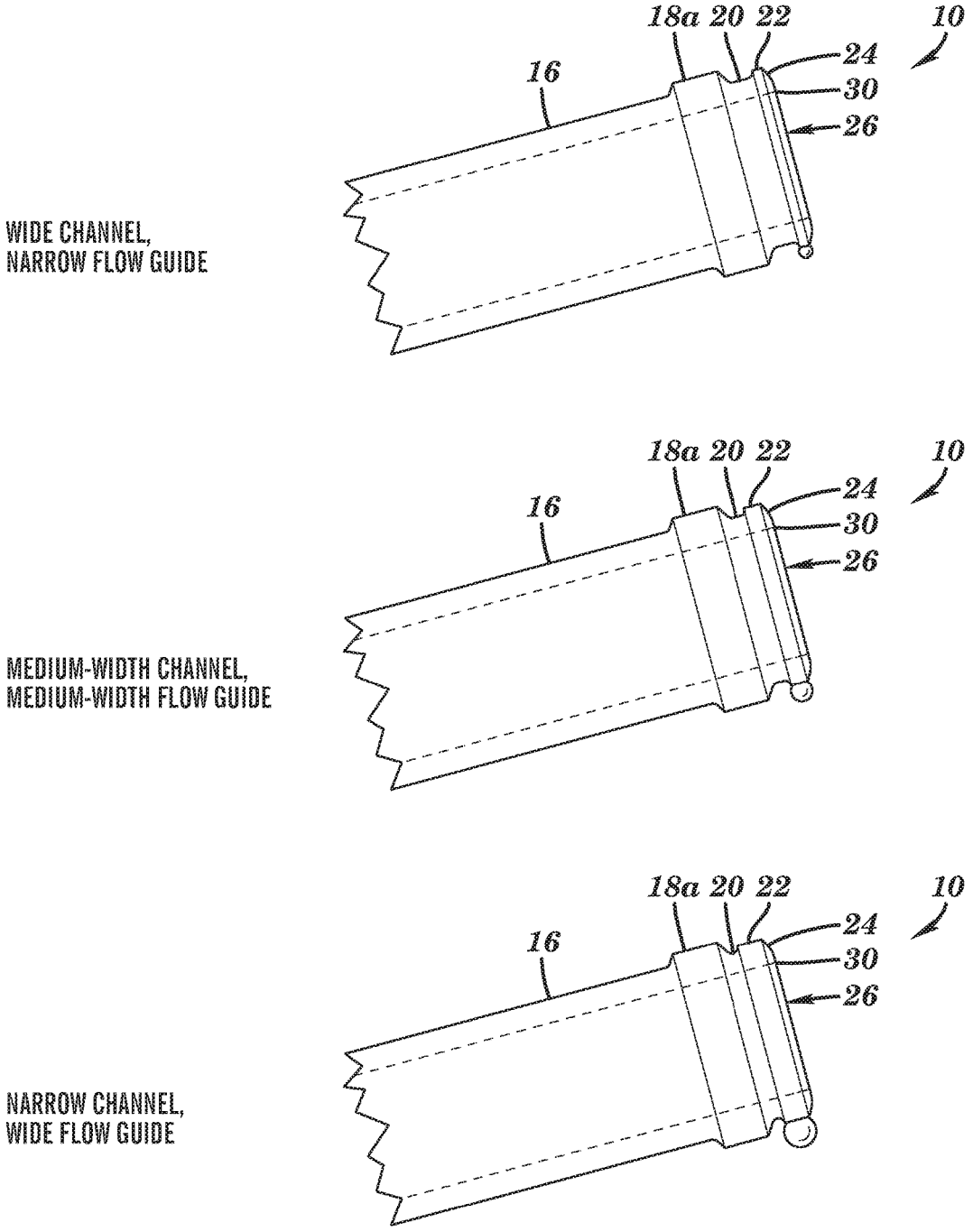
FIG. 6A is a side sectional view of the neck portion of three bottles with different channel configurations. The neck in each is oriented with a 15 degree angle of elevation generally used when pouring liquid from a substantially full bottle.
Figure 6B:
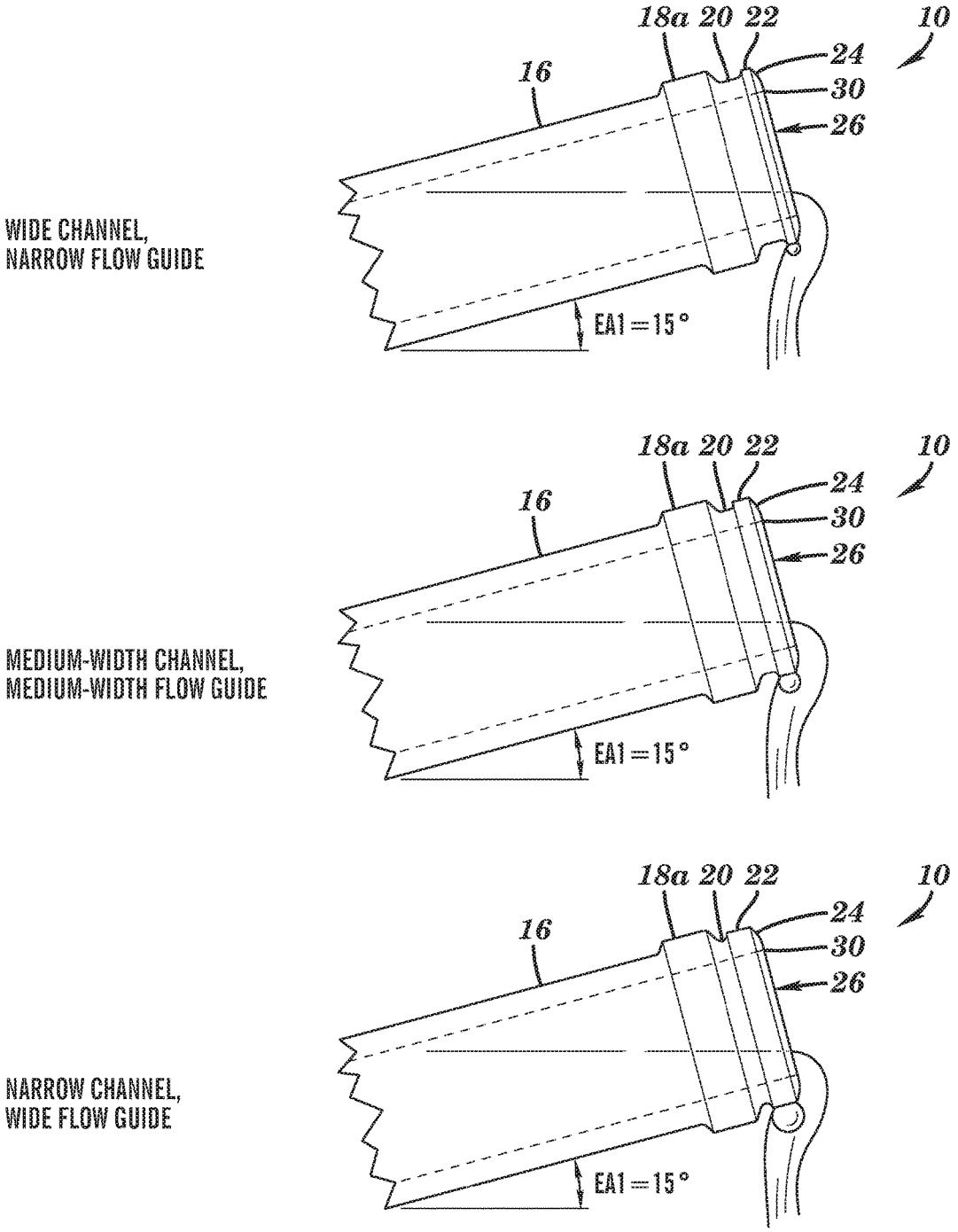
FIG. 6B is a side sectional view of the neck portion of the three bottles shown in FIG. 6A superimposed with a stream of liquid as it flows from the bottle, showing the backward hooked flow.

As illustrated in FIG. 6A and FIG. 6B, decreasing the size of the channel 20 and increasing the width of the flow guide 22 tends to increase and the size of the droplet that forms on the flow guide during pouring or remains on the flow guide immediately after pouring. FIG. 6A shows three neck configurations with channels of varying width and location below the lip edge, as well as a single liquid (e.g., wine) droplet that generally remains as a residue on the flow guide following pouring. In FIG. 6B, the geometry of the exiting liquid stream as the liquid flow rate slows (i.e., as pouring is ceasing, but before the bottle is tilted upright to stand the bottle on a table) is superimposed on the three neck configurations shown in FIG. 6A. The slowed liquid flow occurs in the instant just before a residual droplet forms on the flow guide of the bottle. The droplet either remains adhered to the flow guide or alternatively (and undesirably) drips down the bottle side. Which of these two alternatives occurs depends on two opposing forces, namely the size/weight of the residual droplet versus the binding force, i.e., the capillary adhesive force between the droplet and the glass. The diameter of the droplet has been observed to increase as an approximately linear function of the width of the flow guide, as illustrated in FIG. 6A. The weight or volume of the droplet increases mathematically as the third power of its diameter while the adhesive force should increase at a rate not greater than the second power of the diameter. The latter expectation is reasonable because the capillary contact area between the droplet and the lip should increase at a rate proportional to the surface of the droplet (mathematically as the second power of its diameter). Therefore, the ratio of droplet weight to capillary adhesive force is expected to increase in proportion to the first power of both the droplet's diameter and the width of the flow guide. This is consistent with the observation that when the width of the flow guide increases to greater than approximately 3.0 mm or 3.5 mm (depending on the flow guide's hydrophilicity, surface area, smoothness, and other features of the bottle/liquid that alter surface tension), a liquid droplet can no longer adhere to the lip and will drip down the side of a bottle.

To avoid excessive glass fragility, the channel 20 should be formed/molded only deep enough into the glass wall to enable a droplet to stably remain on the flow guide following pouring. That is, without a channel of adequate depth, a droplet may enter and bridge the channel and run down the wall of the bottle when tilted upright after pouring rather than clinging. It is believed that a combination of physical variables including the liquid contact area around the flow guide, the width of the flow guide, the differential and overall smoothness of the flow guide and lip surfaces, the curvature of the lip surface (if not flat), and the surface tension of the liquid are all involved in determining whether a droplet will remain clinging to the bottle's lip and flow guide or alternatively drip down the bottle's wall. It has been determined that the channel can be approximately 1-3 mm wide and should be, by comparison, shallow in depth so as to avoid introducing excessive fragility into the lip of the bottle but still deep enough (typically at least about 0.75 mm) to prevent a droplet from being drawn from the flow guide into the channel.

The depth of the channel 20 (as measured along a line perpendicular to the center axis of the bottle) should be at least about 0.5 mm, preferably at least about 0.75 mm. Preferably, the depth of the channel 20 is about 0.75-2.5 mm (e.g., about 0.75-1 mm, about 0.75-1.25 mm, about 0.75-1.5 mm, about 0.75-1.75 mm, about 0.75-2 mm, about 0.75-2.25 mm, about 0.75-2.5 mm, about 1-1.25 mm, about 1-1.5 mm, about 1-1.75 mm, about 1-2 mm, about 1-2.25 mm, about 1-2.5 mm, about 1.25-1.5 mm, about 1.25-1.75 mm, about 1.25-2 mm, about 1.25-2.25 mm, about 1.25-2.5 mm, about 1.5-1.75 mm, about 1.5-2 mm, about 1.5-2.25 mm, about 1.5-2.5 mm, about 1.75-2 mm, about 1.75-2.25 mm, about 1.75-2.5 mm, about 2-2.25 mm, about 2-2.5 mm, about 2.25-2.5, about 0.75 mm, about 1 mm, about 1.25 mm, about 1.5 mm, about 1.75 mm, about 2 mm, about 2.25 mm, or about 2.5 mm, preferably about 1 mm, preferably about 1-2 mm, preferably about 1-1.5 mm).

The channel must not be positioned too close to the outer edge of the lip of the bottle or else the resulting narrow glass flow guide will be too fragile. The channel 20 must also be wide enough to create a large enough gap between the flow guide and the lower edge of the channel (and, if present, the optional neck collar/screw thread assembly) such that the stream of liquid during pouring does not breach or "jump" the channel. Accordingly, the upper edge of the channel 20 should be at least about 1.0 mm below the outer edge of the lip of the bottle. However, the channel 20 should not be placed so far below the outer edge of lip 24 of the bottle as to create a wide/large enough flow guide to cause formation of large droplets (preferably not a greater distance than about 3-4 mm (e.g., about 3 mm, about 3.5 mm, or about 4 mm) below the outer edge of lip 24).

In one embodiment, the upper edge of the channel 20 is about 1-3.5 mm (e.g., about 1-1.25 mm, about 1-1.5 mm, about 1-1.75 mm, about 1-2 mm, about 1-2.25 mm, about 1-2.5 mm, about 1-2.75 mm, about 1-3 mm, about 1-3.25 mm, about 1.25-1.5 mm, about 1.25-1.75 mm, about 1.25-2 mm, about 1.25-2.25 mm, about 1.25-2.5 mm, about 1.25-2.75 mm, about 1.25-3 mm, about 1.25-3.25 mm, about 1.25-3.5 mm, about 1.5-1.75 mm, about 1.5-2 mm, about 1.5-2.25 mm, about 1.5-2.5 mm, about 1.5-2.75 mm, about 1.5-3 mm, about 1.5-3.25 mm, about 1.5-3.5 mm, about 1.75-2 mm, about 1.75-2.25 mm, about 1.75-2.5 mm, about 1.75-2.75 mm, about 1.75-3 mm, about 1.75-3.25 mm, about 1.75-3.5 mm, about 2-2.25 mm, about 2-2.5 mm, about 2-2.75 mm, about 2-3 mm, about 2-3.25 mm, about 2-3.5 mm, about 2.25-2.5 mm, about 2.25-2.75 mm, about 2.25-3 mm, about 2.25-3.25 mm, about 2.25-3.5 mm, about 2.5-2.75 mm, about 2.5-3 mm, about 2.5-3.25 mm, about 2.5-3.5 mm, about 2.75-3 mm, about 2.75-3.25 mm, about 2.75-3.5 mm, about 3-3.25 mm, about 3-3.5 mm, about 3.25-3.5 mm, about 1 mm, about 1.25 mm, about 1.5 mm, about 1.75 mm, about 2 mm, about 2.25 mm, about 2.5 mm, about 2.75 mm, about 3 mm, about 3.25 mm, or about 3.5 mm, preferably about 1.5-3 mm, preferably at least about 1.8 mm, at least about 2 mm, at least about 2.3 mm, at least about 2.5 mm, at least about 2.7 mm, or at least about 2.9 mm) below the outer edge of the lip of the bottle.

The width of the channel 20 (as measured from the top of the channel to the bottom of the channel along a line parallel to the center axis) should be at least about 1 mm (preferably at least about 1.5 mm). In at least one embodiment, the width of the channel is about 1-3 mm (e.g., about 1-1.25 mm, about 1-1.5 mm, about 1-1.75 mm, about 1-2 mm, about 1-2.25 mm, about 1-2.5 mm, about 1-2.75 mm, about 1-3 mm, about 1.25-1.5 mm, about 1.25-1.75 mm, about 1.25-2 mm, about 1.25-2.25 mm, about 1.25-2.5 mm, about 1.25-2.75 mm, about 1.25-3 mm, about 1.5-1.75 mm, about 1.5-2 mm, about 1.5-2.25 mm, about 1.5-2.5 mm, about 1.5-2.75 mm, about 1.5-3 mm, about 1.75-2 mm, about 1.75-2.25 mm, about 1.75-2.5 mm, about 1.75-2.75 mm, about 1.75-3 mm, about 2-2.25 mm, about 2-2.5 mm, about 2-2.75 mm, about 2-3 mm, about 2.25-2.5 mm, about 2.25-2.75 mm, about 2.25-3 mm, about 2.5-2.75 mm, about 2.5-3 mm, about 2.75-3 mm, about 1 mm, about 1.25 mm, about 1.5 mm, about 1.75 mm, about 2 mm, about 2.25 mm, about 2.5 mm, about 2.75 mm, or about 3 mm, preferably about 1.5-2.5 mm, preferably about 1.5-3 mm, preferably about 2-3 mm, preferably about 2 mm).

Figure 7:
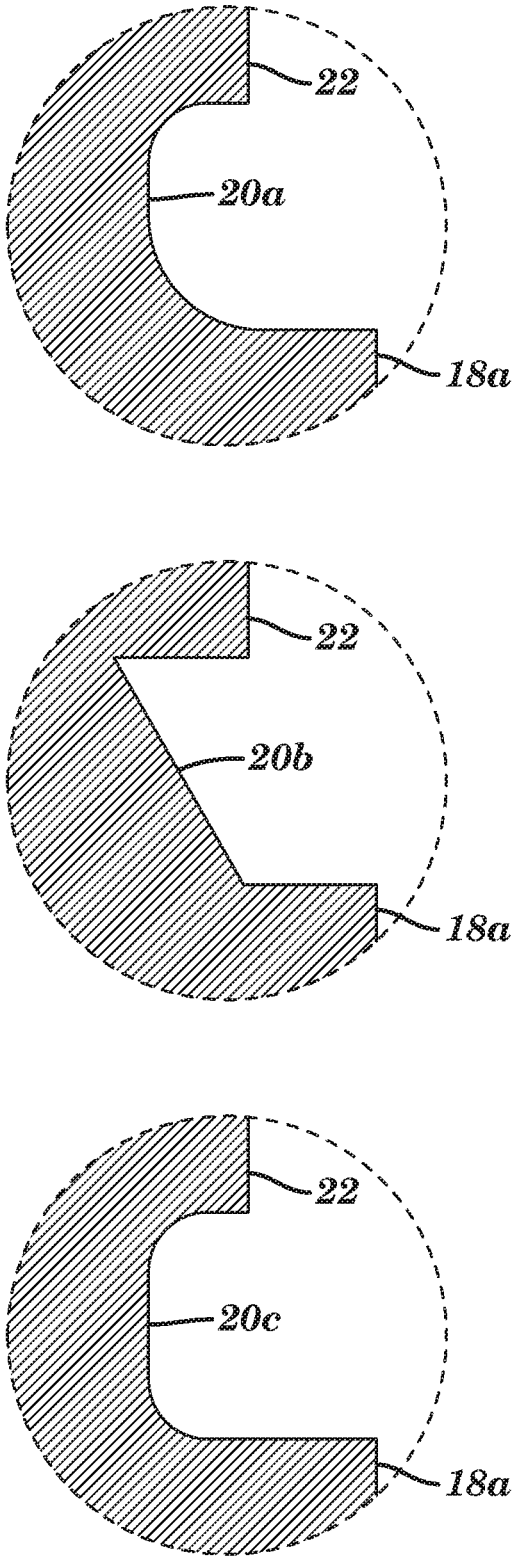
FIG. 7 is a magnified side sectional view of the upper neck portion of three exemplary drip-free bottles having differently-shaped channels.

As illustrated in FIG. 7, the shape of channel 20 may be varied as well. For example, the cross-sectional profile of the bottom of channel 20 can be, for example, semi-circular (cup-shaped) (channel 20*a*), V-shaped (channel 20*b*), or square-shaped (channel 20*c*).

Preferably, the slope of the wall forming the upper side of the circumferential channel is formed to be as steep as possible and is therefore either perpendicular or nearly perpendicular to the center axis of the bottle to prevent liquid from creeping/edging into the channel caused by the liquid's affinity for the glass surface. For example, the slope of the wall forming the upper side of the channel measured at the wall's midpoint, relative to the center axis of the bottle is about 60-90 degrees (e.g., about 60-70 degrees, about 60-80 degrees, about 70-80 degrees, about 70-90 degrees, or about 80-90 degrees). By comparison, a less steep, rounded, and/or gradually sloping wall forming the upper side of the channel may allow liquid to enter and fill the channel, thereby bridging the channel and defeating the channel as a barrier against liquid flow, resulting in liquid dripping down the outside of the bottle. For example, if the slope of the wall forming the upper side of the channel measured at its midpoint is approximately 45-50 degrees, for example, it may allow liquid to enter the channel and defeat the channel's barrier properties. Similarly, the radius of curvature of the upper edge of the channel should be as small as possible, creating a sharp delineation between the flow guide and the wall forming the upper side of the channel. Preferably, the radius of curvature of the upper edge of the channel is no more than about 0.5 mm (e.g., less than about 0.5 mm, less than about 0.4 mm, less than about 0.3 mm, less than about 0.2 mm), as described more fully below.

When the bottle includes a neck collar or screw thread assembly, in one embodiment, the lower edge of the channel is preferably contiguous with the upper surface of the neck collar/screw thread assembly, forming a smooth continuity between the two features (as shown, for example, in FIGS. 4B and 4C). In another embodiment, there is a slight step between the lower edge of the neck channel and the upper surface of the neck collar/screw thread assembly. In such embodiments, the exterior surface of the step is on the same plane as the exterior surface of the flow guide. Thus, the lower edge of the channel is about 0-3 mm (e.g., about 0-0.25 mm, about 0-0.5 mm, about 0-0.75 mm, about 0-1 mm, about 0-1.25 mm, about 0-1.5 mm, about 0-1.75 mm, about 0-2 mm, about 0-2.25 mm, about 0-2.5 mm, about 0-2.75 mm, about 0.25-0.5 mm, about 0.25-0.75 mm, about 0.25-1 mm, about 0.25-1.25 mm, about 0.25-1.5 mm, about 0.25-1.75 mm, about 0.25-2 mm, about 0.25-2.25 mm, about 0.25-2.5 mm, about 0.25-2.75 mm, about 0.25-3 mm, about 0.5-0.75 mm, about 0.5-1 mm, about 0.5-1.25 mm, about 0.5-1.5 mm, about 0.5-1.75 mm, about 0.5-2 mm, about 0.5-2.25 mm, about 0.5-2.5 mm, about 0.5-2.75 mm, about 0.5-3 mm, about 0.75-1 mm, about 0.75-1.25 mm, about 0.75-1.5 mm, about 0.75-1.75 mm, about 0.75-2 mm, about 0.75-2.25 mm, about 0.75-2.5 mm, about 0.75-2.75 mm, about 0.75-3 mm, about 1-1.25 mm, about 1-1.5 mm, about 1-1.75 mm, about 1-2 mm, about 1-2.25 mm, about 1-2.5 mm, about 1-2.75 mm, about 1-3 mm, about 1.25-1.5 mm, about 1.25-1.75 mm, about 1.25-2 mm, about 1.25-2.25 mm, about 1.25-2.5 mm, about 1.25-2.75 mm, about 1.25-3 mm, about 1.5-1.75 mm, about 1.5-2 mm, about 1.5-2.25 mm, about 1.5-2.5 mm, about 1.5-2.75 mm, about 1.5-3 mm, about 1.75-2 mm, about 1.75-2.25 mm, about 1.75-2.5 mm, about 1.75-2.75 mm, about 1.75-3 mm, about 2-2.25 mm, about 2-2.5 mm, about 2-2.75 mm, about 2-3 mm, about 2.25-2.5 mm, about 2.25-2.75 mm, about 2.25-3 mm, about 2.5-2.75 mm, about 2.5-3 mm, about 2.75-3 mm, about 0 mm, about 0.25 mm, about 0.5 mm, about 0.75 mm, about 1 mm, about 1.25 mm, about 1.5 mm, about 1.75 mm, about 2 mm, about 2.25 mm, about 2.5 mm, about 2.75 mm, or about 3 mm, preferably about 0-2 mm) above the neck collar/screw thread assembly.

The maximum width (measured top to bottom along the axis of the bottle) for the flow guide to still retain a droplet (often having a volume of approximately 25 microliters or somewhat less, such as approximately 20 microliters, 18 microliters, or 15 microliters) may vary if either or both the glass surface properties (e.g., dried wine residues, hydrophobicity, and glass surface roughness) or the alcohol content of the liquid vary, since these properties can alter the liquid surface tension and capillary adhesive force that maintains a droplet on a bottle's flow guide. Notwithstanding these somewhat uncontrollable variables, the width of the flow guide 22 should generally be maintained at about 1-3.5 mm (e.g., about 1-1.25 mm, about 1-1.5 mm, about 1-1.75 mm, about 1-2 mm, about 1-2.25 mm, about 1-2.5 mm, about 1-2.75 mm, about 1-3 mm, about 1-3.25 mm, about 1.25-1.5 mm, about 1.25-1.75 mm, about 1.25-2 mm, about 1.25-2.25 mm, about 1.25-2.5 mm, about 1.25-2.75 mm, about 1.25-3 mm, about 1.25-3.25 mm, about 1.25-3.5 mm, about 1.5-1.75 mm, about 1.5-2 mm, about 1.5-2.25 mm, about 1.5-2.5 mm, about 1.5-2.75 mm, about 1.5-3 mm, about 1.5-3.25 mm, about 1.5-3.5 mm, about 1.75-2 mm, about 1.75-2.25 mm, about 1.75-2.5 mm, about 1.75-2.75 mm, about 1.75-3 mm, about 1.75-3.25 mm, about 1.75-3.5 mm, about 2-2.25 mm, about 2-2.5 mm, about 2-2.75 mm, about 2-3 mm, about 2-3.25 mm, about 2-3.5 mm, about 2.25-2.5 mm, about 2.25-2.75 mm, about 2.25-3 mm, about 2.25-3.25 mm, about 2.25-3.5 mm, about 2.5-2.75 mm, about 2.5-3 mm, about 2.5-3.25 mm, about 2.5-3.5 mm, about 2.75-3 mm, about 2.75-3.25 mm, about 2.75-3.5 mm, about 3-3.25 mm, about 3-3.5 mm, about 3.25-3.5 mm, about 1 mm, about 1.25 mm, about 1.5 mm, about 1.75 mm, about 2 mm, about 2.25 mm, about 2.5 mm, about 2.75 mm, about 3 mm, about 3.25 mm, or about 3.5 mm) and more typically about 1-3 mm (preferably about 1.0-1.5 mm, about 1.0-2.0 mm, or about 1.0-2.5 mm; preferably at least about 1.5 mm or at least about 2 mm; preferably about 1 mm, about 1.5 mm, or about 2.0 mm; more preferably about 1-1.5 mm, more preferably about 1.5 mm).

Thus, the flow guide 22 of the bottle of the present technology has an adequate width that, along with its surface properties, can provide a greater capillary attraction force for liquid than the weight of the last droplet(s) of liquid (e.g., wine). The flow guide may be assisted in liquid droplet retention by participation of the surface and outer edge of lip 24. These elements together can achieve a balance of forces (capillary attraction versus droplet weight) such that the last droplet remains attached by capillary attraction, rather than either falling downward to cause a drip or being drawn back into the bottle. The channel 20 is located appropriately and also has adequate width and depth (within the dimension ranges above), such that the channel 20 reliably functions as a barrier that resists any liquid when poured from entering the channel or jumping the channel. Liquid that exits the bottle (by either slow or fast pouring) flows out over the lip and down no further than the channel.

The lip 24 extends from the upper edge of flow guide 22 to an inner edge 30. The outer diameter of the lip 24 defined by the upper edge of flow guide 22 may be approximately 1.05-1.2 inches, although the upper edge of flow guide 22 and the lip 24 may have other diameters. The width or thickness of the lip, from the upper edge of flow guide 22 to the inner edge 30, may be for, example, about 2-6 mm (e.g., about 2-3 mm, about 2-4 mm, about 2-5 mm, about 3-4 mm, about 3-5 mm, about 3-6 mm, about 4-5 mm, about 4-6 mm, about 5-6 mm, about 2 mm, about 3 mm, about 4 mm, about 5 mm, or about 6 mm, preferably about 5 mm), as measured along a line perpendicular to the center axis. For corked bottles, a comparatively thicker lip (and neck wall) is preferred, as thicker bottles are better able to resist stresses applied during uncorking; a comparatively thinner lip/neck wall can be used for bottles with other closures. The inner edge 30 defines the substantially round bottle orifice 26 at one end of the interior bore 17 of the neck 16.

Figure 8A:
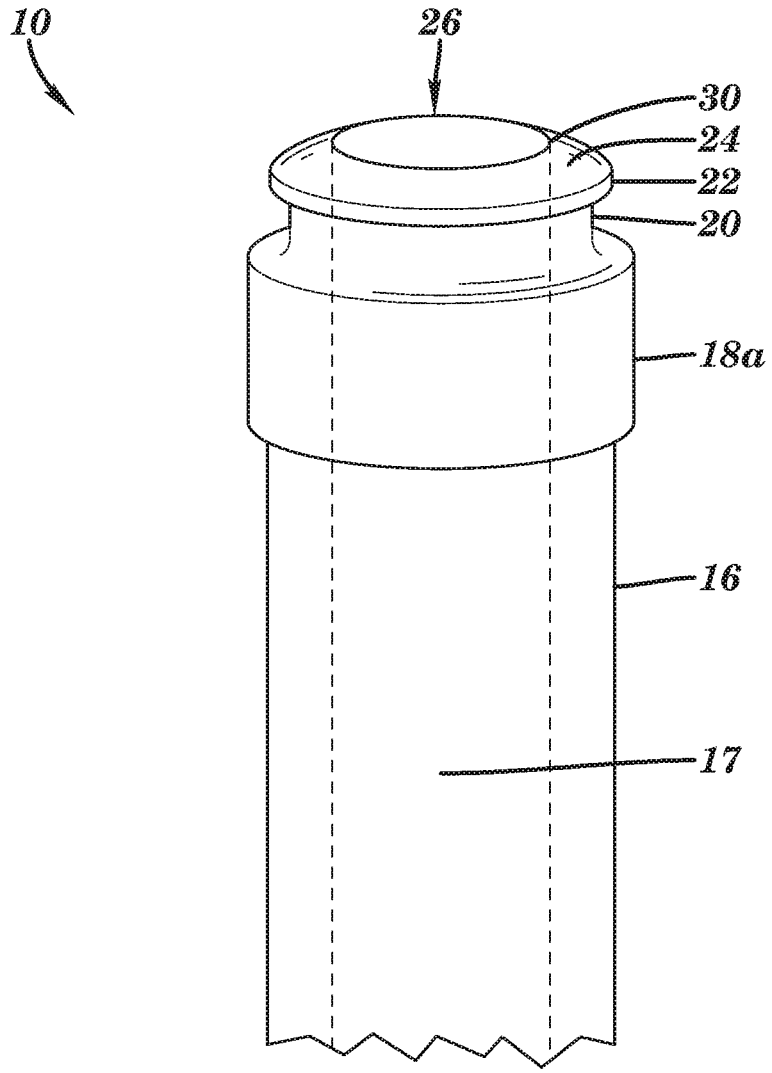
FIG. 8A is a magnified perspective view of the neck portion of an exemplary drip-free bottle having a domed lip and an optional neck collar.
Figure 8B:
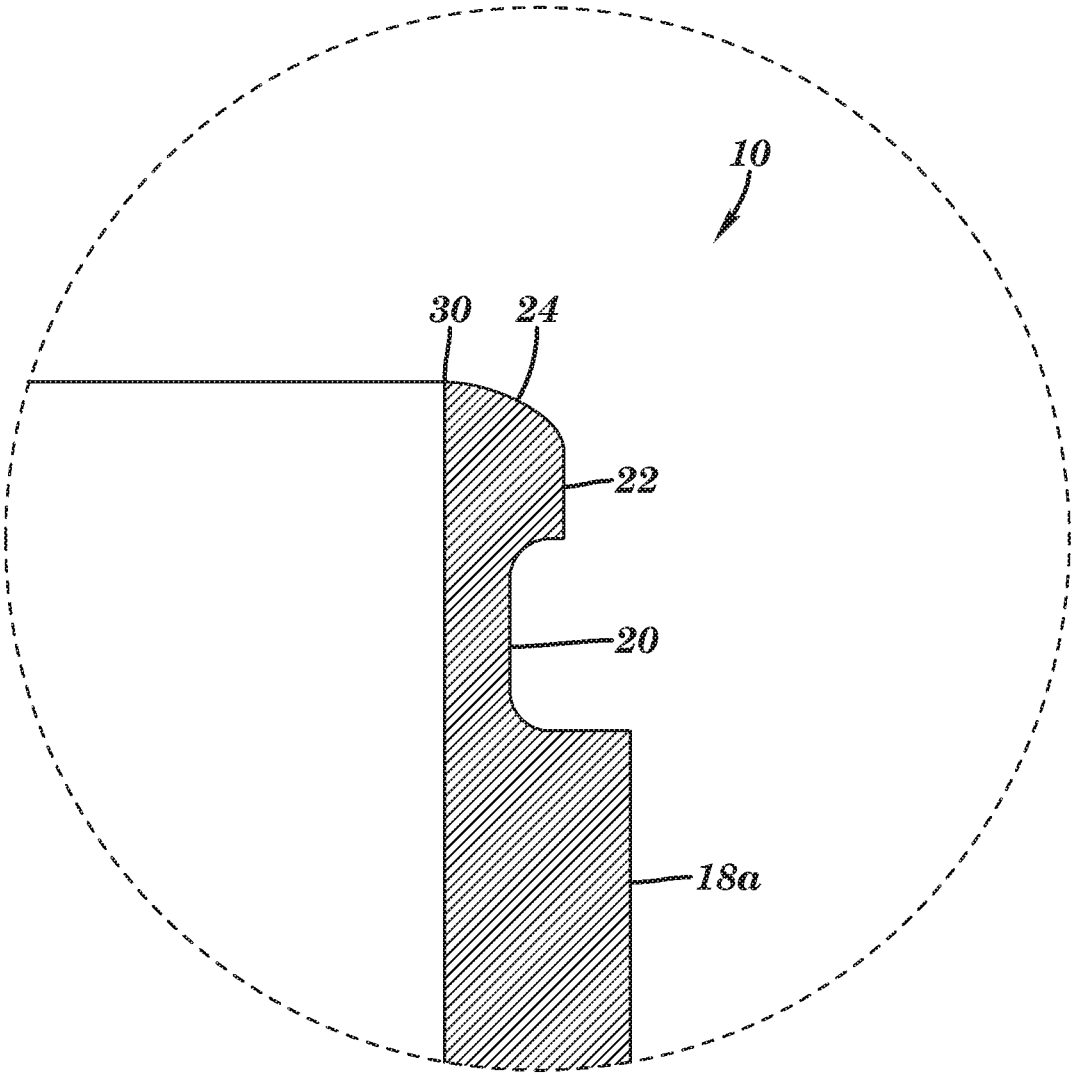
FIG. 8B is a magnified side sectional view of the upper portion of the drip-free bottle shown in FIG. 8A.

As illustrated in FIG. 3 and FIG. 8A and FIG. 8B, the bottles may differ with regard to the shape of the lip 24 surrounding the round orifice of the bottle, in which the uppermost end or top surface may be either flat (FIG. 3) or dome-shaped/convex (FIG. 8A and FIG. 8B) (never concave). In one embodiment, lip 24 forms a concentric ring around the orifice 26 and is formed as a substantially flat horizontal surface (see FIG. 3).

In a preferred embodiment, lip 24 is formed as a domed/convex top extending greater than 0.0 mm above the flow guide (see FIG. 8A and FIG. 8B). In one embodiment, the top extends about 0-2 mm (e.g., about 0-0.25 mm, about 0-0.5 mm, about 0-0.75 mm, about 0-1 mm, about 0-1.25 mm, about 0-1.5 mm, about 0-1.75 mm, about 0-2 mm, about 0.25-0.5 mm, about 0.25-0.75 mm, about 0.25-1 mm, about 0.25-1.25 mm, about 0.25-1.5 mm, about 0.25-1.75 mm, about 0.25-2 mm, about 0.5-0.75 mm, about 0.5-1 mm, about 0.5-1.25 mm, about 0.5-1.5 mm, about 0.5-1.75 mm, about 0.5-2 mm, about 0.75-1 mm, about 0.75-1.25 mm, about 0.75-1.5 mm, about 0.75-1.75 mm, about 0.75-2 mm, about 1-1.25 mm, about 1-1.5 mm, about 1-1.75 mm, about 1-2 mm, about 1.25-1.5 mm, about 1.25-1.75 mm, about 1.25-2 mm, about 1.5-1.75 mm, about 1.5-2 mm, about 1.75-2 mm, about 0 mm, about 0.25 mm, about 0.5 mm, about 0.75 mm, about 1 mm, about 1.25 mm, about 1.5 mm, about 1.75 mm, or about 2 mm, preferably about 1-2 mm) above the flow guide. In one embodiment, the curvature and resulting elevation angle/upward slope measured from the outer edge of the lip inward toward the inner edge 30 of lip 24 does not exceed an upward angle of about 30 degrees, although other angles may be utilized to provide a substantially flat surface for the lip 24, such as upward slopes ranging from about 5-10 degrees, about 5-15 degrees, about 5-20 degrees, about 5-25 degrees, about 5-30 degrees, about 10-15 degrees, about 10-20 degrees, about 10-25 degrees, about 10-30 degrees, about 15-20 degrees, about 15-25 degrees, about 15-30 degrees, about 20-25 degrees, about 20-30 degrees, about 25-30 degrees, about 5 to 8 degrees, about 3 to 6 degrees, about 2 to 4 degrees, >0 to 3 degrees, >0 to 2 degrees, or even >0 to 1 degree. In one embodiment, the curvature and resulting elevation angle/upward slope measured from the outer edge of the lip inward toward the inner edge 30 of lip 24 is 10 to 30 degrees, such as upward slopes ranging from 10 to 15 degrees, 10 to 20 degrees, 10 to 25 degrees, 10 to 30 degrees, 15 to 20 degrees, 15 to 25 degrees, 15 to 30 degrees, 20 to 25 degrees, 20 to 30 degrees, or 25 to 30 degrees.

The domed/convex shape is particularly preferred for bottles having a cork-style closure, as the domed/convex shape assures that cork removal tools will selectively apply force to the strong central core of the glass bottle rather than to the weaker outer circumference region of the bottle where the circumferential channel may somewhat weaken the outer portion of the neck. Although a domed/convex lip on a traditional bottle can actually promote the flow of liquid to curl back and drip along the outer surface of the neck, this tendency can be overcome by combining a domed/convex lip with appropriately sized and positioned flow guide 22 and circumferential channel 20. Without wishing to be bound by theory, the preferred domed shape provides at least two advantages. First, forces applied to the top of the bottle during cork/plug seal removal by a corkscrew (especially a lever-style corkscrew) are directed and concentrated on the tallest portion/uppermost surface element in the bottle's architecture. Therefore, a domed shape serves to direct any downward forces of a corkscrew into the middle or core portion of the glass wall of the neck, and not onto the more fragile outer rim or edge portion of the bottle. By comparison, a flat uppermost surface may expose the more fragile outer rim or edge portion of the bottle to excessive downward forces during use of a corkscrew and possibly result in glass breakage or chipping. Second, when pouring from a full bottle with the center axis of the bottle typically angled upward from the horizontal at an angle of approximately 15 to 20 degrees, a 15-20 degree downward sloping angle formed on the uppermost "top" surface of the bottle having a dome-shaped lip 24 (surrounding the bottle's orifice) almost exactly offsets the upward pouring angle of the bottle. The result is that the uppermost "top" surface of the bottle is oriented essentially vertical during pouring, allowing liquid to drop out of the bottle's orifice essentially vertically during initial pouring, thereby minimizing backward "curling" of the exiting stream of liquid. This curling contributes to turbulent flow and to the dripping problem. Upon tilting the bottle upright after pouring, the dome-shaped architecture promotes the last droplet(s) of liquid to flow over the lip edge and downward where the droplet remains and binds by sufficient capillary attraction to the flow guide. This second advantage would also be useful in bottles that do not require a cork-screw to open.

In one embodiment, the inner edge 30 of the lip is configured (e.g., by polishing or molding) to have a radiused edge with a radius of curvature of about 0.5-2.5 mm (e.g., about 0.5-0.75 mm, about 0.5-1 mm, about 0.5-1.25 mm, about 0.5-1.5 mm, about 0.5-1.75 mm, about 0.5-2 mm, about 0.5-2.25 mm, about 0.5-2.5 mm, about 0.75-1 mm, about 0.75-1.25 mm, about 0.75-1.5 mm, about 0.75-1.75 mm, about 0.75-2 mm, about 0.75-2.25 mm, about 0.75-2.5 mm, about 1-1.25 mm, about 1-1.5 mm, about 1-1.75 mm, about 1-2 mm, about 1-2.25 mm, about 1-2.5 mm, about 1.25-1.5 mm, about 1.25-1.75 mm, about 1.25-2 mm, about 1.25-2.25 mm, about 1.25-2.5 mm, about 1.5-1.75 mm, about 1.5-2 mm, about 1.5-2.25 mm, about 1.5-2.5 mm, about 1.75-2 mm, about 1.75-2.25 mm, about 1.75-2.5 mm, about 2-2.25 mm, about 2-2.5 mm, about 2.25-2.5 mm, about 0.5 mm, about 0.75 mm, about 1 mm, about 1.25 mm, about 1.5 mm, about 1.75 mm, about 2 mm, about 2.25 mm, more typically about 1-2 mm) at the inner edge 30 of lip 24 to reduce the risk of chipping or breakage and/or facilitate insertion of a cork or other plug-style closure. Preferably, the radiused edge is about 0.5-2 mm (e.g., about 0.5-0.75 mm, about 0.5-1 mm, about 0.5-1.25 mm, about 0.5-1.5 mm, about 0.5-1.75 mm, about 0.5-2 mm, about 0.75-1 mm, about 0.75-1.25 mm, about 0.75-1.5 mm, about 0.75-1.75 mm, about 0.75-2 mm, about 1-1.25 mm, about 1-1.5 mm, about 1-1.75 mm, about 1-2 mm, about 1.25-1.5 mm, about 1.25-1.75 mm, about 1.25-2 mm, about 1.5-1.75 mm, about 1.5-2 mm, about 1.75-2 mm, about 0.5 mm, about 0.75 mm, about 1 mm, about 1.25 mm, about 1.5 mm, about 1.75 mm, about 2 mm, preferably about 1-1.5 mm) in height, as measured from the top of the radiused edge to the bottom of the radiused edge along a line parallel to the center axis of the bottle. This height is small enough that the cylindrical bore 17 can still be sealed with a plug style closure, which can be removable with a corkscrew or by hand twist removal.

Figure 9:
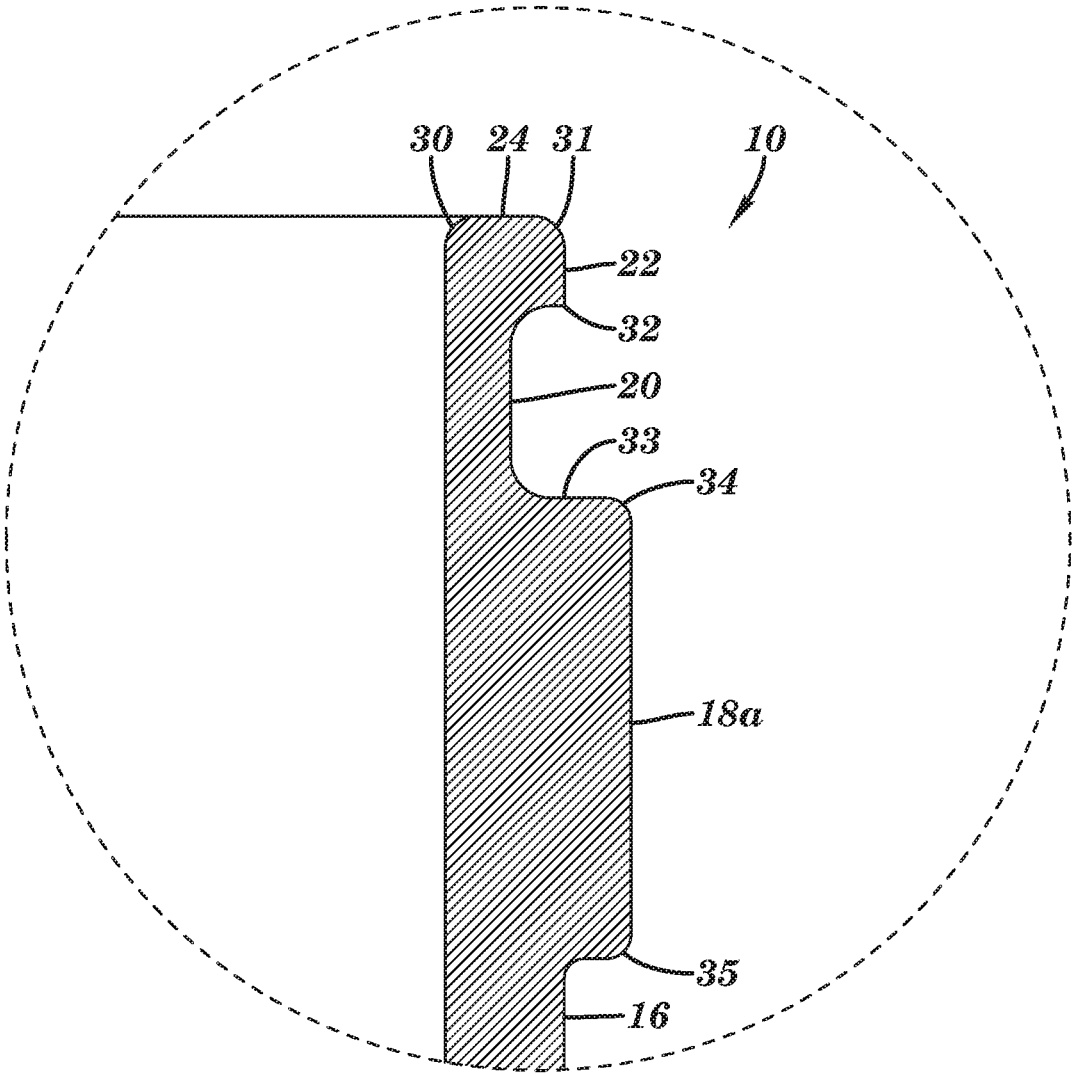
FIG. 9 is a magnified side sectional view of the upper portion of an exemplary drip-free bottle having radiused edges 30, 31, 33, 34, and 35, and minimally radiused edge 32.

As illustrated in FIG. 9, most of the other edges of the bottle can also optionally be configured (e.g., by polishing or molding) to have a radiused edge to reduce the risk of chipping or breakage. These include the outer edge 31 of the lip, the lower edge 33 of the channel 20 (especially when the channel has a V-shaped or square-shaped cross-section), and the upper edge 34 and lower edge 35 of the neck collar (and any of the edges of the screw thread assembly). In all these cases, the radius of curvature of the radiused edge is about 0.5-2.5 mm (e.g., about 0.5-0.75 mm, about 0.5-1 mm, about 0.5-1.25 mm, about 0.5-1.5 mm, about 0.5-1.75 mm, about 0.5-2 mm, about 0.5-2.25 mm, about 0.5-2.5 mm, about 0.75-1 mm, about 0.75-1.25 mm, about 0.75-1.5 mm, about 0.75-1.75 mm, about 0.75-2 mm, about 0.75-2.25 mm, about 0.75-2.5 mm, about 1-1.25 mm, about 1-1.5 mm, about 1-1.75 mm, about 1-2 mm, about 1-2.25 mm, about 1-2.5 mm, about 1.25-1.5 mm, about 1.25-1.75 mm, about 1.25-2 mm, about 1.25-2.25 mm, about 1.25-2.5 mm, about 1.5-1.75 mm, about 1.5-2 mm, about 1.5-2.25 mm, about 1.5-2.5 mm, about 1.75-2 mm, about 1.75-2.25 mm, about 1.75-2.5 mm, about 2-2.25 mm, about 2-2.5 mm, about 2.25-2.5 mm, about 0.5 mm, about 0.75 mm, about 1 mm, about 1.25 mm, about 1.5 mm, about 1.75 mm, about 2 mm, about 2.25 mm, more typically about 1-2 mm), and the height (measured from the top of the radiused edge to the bottom of the radiused edge along a line parallel to the center axis of the bottle) is about 0.5-2 mm (e.g., about 0.5-0.75 mm, about 0.5-1 mm, about 0.5-1.25 mm, about 0.5-1.5 mm, about 0.5-1.75 mm, about 0.5-2 mm, about 0.75-1 mm, about 0.75-1.25 mm, about 0.75-1.5 mm, about 0.75-1.75 mm, about 0.75-2 mm, about 1-1.25 mm, about 1-1.5 mm, about 1-1.75 mm, about 1-2 mm, about 1.25-1.5 mm, about 1.25-1.75 mm, about 1.25-2 mm, about 1.5-1.75 mm, about 1.5-2 mm, about 1.75-2 mm, about 0.5 mm, about 0.75 mm, about 1 mm, about 1.25 mm, about 1.5 mm, about 1.75 mm, about 2 mm, preferably about 1-1.5 mm).

The top edge 32 of the channel 20, however, is preferably minimally radiused (i.e., near enough to zero that is within the practical limits of industrial glass bottle molding yet does not create a cutting hazard) to form a relatively sharp, cliff-like edge at the junction between the flow guide 22 and the channel 20. For example, the radius of curvature of the upper edge 32 is about 0.05-0.5 mm (e.g., about 0.05-0.1 mm, about 0.05-0.15 mm, about 0.05-0.2 mm, about 0.05-0.25 mm, about 0.05-0.3 mm, about 0.05-0.35 mm, about 0.05-0.4 mm, about 0.05-0.45 mm, about 0.05-0.5 mm, about 0.1-0.15 mm, about 0.1-0.2 mm, about 0.1-0.25 mm, about 0.1-0.3 mm, about 0.1-0.35 mm, about 0.1-0.4 mm, about 0.1-0.45 mm, about 0.1-0.5 mm, about 0.15-0.2 mm, about 0.15-0.25 mm, about 0.15-0.3 mm, about 0.15-0.35 mm, about 0.15-0.4 mm, about 0.15-0.45 mm, about 0.15-0.5 mm, about 0.2-0.25 mm, about 0.2-0.3 mm, about 0.2-0.35 mm, about 0.2-0.4 mm, about 0.2-0.45 mm, about 0.2-0.5 mm, about 0.25-0.3 mm, about 0.25-0.35 mm, about 0.25-0.4 mm, about 0.25-0.45 mm, about 0.25-0.5 mm, about 0.3-0.35 mm, about 0.3-0.4 mm, about 0.3-0.45 mm, about 0.3-0.5 mm, about 0.35-0.4 mm, about 0.35-0.45 mm, about 0.35-0.5 mm, about 0.4-0.45 mm, about 0.4-0.5 mm, about 0.45-0.5 mm, about 0.05 mm, about 0.1 mm, about 0.15 mm, about 0.2 mm, about 0.25 mm, about 0.3 mm, about 0.35 mm, about 0.4 mm, about 0.45 mm, about 0.5 mm), preferably about 0.05-3 mm, preferably about 0.1-0.2 mm, preferably about 0.2 mm. This sharp edge helps prevent the residual droplet from seeping into the channel and then dripping down onto the neck collar and down along the bottle. The height of the minimally radiused edge (measured from the top of the radiused edge to the bottom of the radiused edge along a line parallel to the center axis of the bottle) is about 0.05-0.4 mm (e.g., about 0.05-0.1 mm, about 0.05-0.15 mm, about 0.05-0.2 mm, about 0.05-0.25 mm, about 0.05-0.3 mm, about 0.05-0.35 mm, about 0.05-0.4 mm, about 0.1-0.15 mm, about 0.1-0.2 mm, about 0.1-0.25 mm, about 0.1-0.3 mm, about 0.1-0.35 mm, about 0.1-0.4 mm, about 0.15-0.2 mm, about 0.15-0.25 mm, about 0.15-0.3 mm, about 0.15-0.35 mm, about 0.15-0.4 mm, about 0.2-0.25 mm, about 0.2-0.3 mm, about 0.2-0.35 mm, about 0.2-0.4 mm, about 0.25-0.3 mm, about 0.25-0.35, about 0.25-0.4 mm, about 0.3-0.35 mm, about 0.3-0.4 mm, about 0.35-0.4 mm, about 0.05 mm, about 0.1 mm, about 0.15 mm, about 0.2 mm, about 0.25 mm, about 0.3 mm, about 0.35 mm, about 0.4 mm), preferably about 0.15-0.2 mm.

Figure 10:
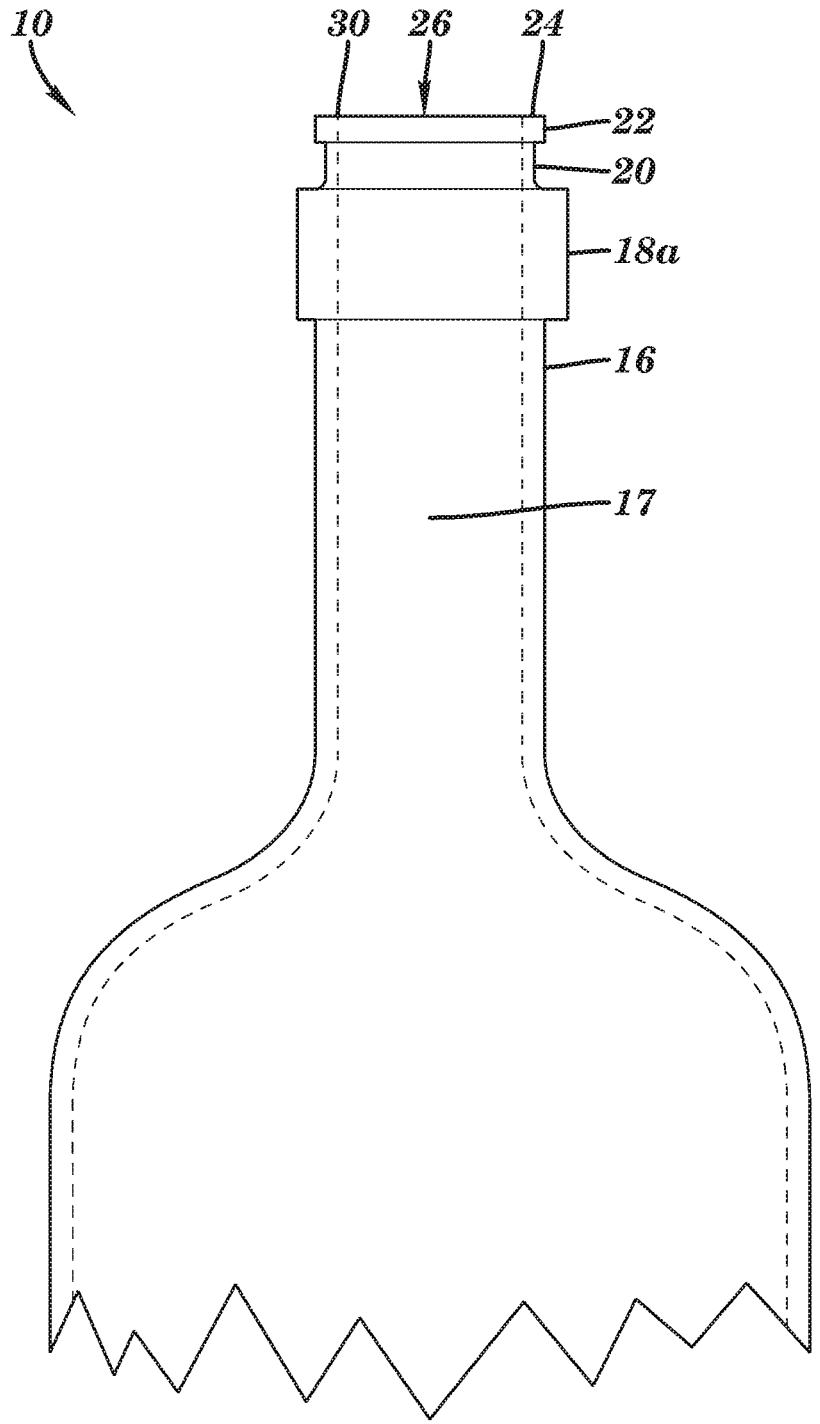
FIG. 10 is a side sectional view of the neck and shoulder portions of an exemplary drip-free bar top bottle in which a circumferential channel has been introduced into the collar wall to produce a flow guide and neck collar.

Referring more specifically to FIG. 10, distilled alcohol and alcohol-enriched beverages (e.g., Scotch, bourbon, liqueur, Port, sherry, etc.) are often packaged in bottles having "bar top" neck finishes that are sealed with manually twistable/removable plug-style closures having a T profile. Bottles with bar top neck finishes typically have thick-walled cylindrical necks that extend from the lip of the bottle downward approximately 10 mm-15 mm. The uppermost lip surface of such bottles is generally flat rather than rounded or dome-shaped. The wall thickness of the uppermost 10 mm of the neck finish of such bottles is typically 4-6 mm. As shown in FIG. 10, the channel can be integrated into the neck finish of these types of bottles as well, effectively forming a bottle in which the silhouette of the upper region of the neck is similar to that shown in FIG. 4B (having a lip 24, flow guide 22, channel 20, and neck collar 18*a*), except that the lip extends outward such that it is even with the outer surface of the neck collar. The dimensions for the flow guide, channel, and neck collar described above are applicable for bar top bottles as well. However, the width or thickness of the lip, from the upper edge of flow guide 22 to the inner edge 30 as measured along a line perpendicular to the center about 5-10 mm, about 6-7 mm, about 6-8 mm, about 6-9 mm, about 6-10 mm, about 7-8 mm, about 7-9 mm, about 7-10 mm, about 8-9 mm, about 8-10 mm, about 9-10 mm, about 5 mm, about 6 mm, about 7 mm, about 8 mm, about 9 mm, about 10 mm) and the diameter of the lip (defined by the upper edge of flow guide 22) is typically about 25-35 mm (e.g., about 25-27 mm, about 25-29 mm, about 25-31 mm, about 25-33 mm, about 25-35 mm, about 27-29 mm, about 27-31 mm, about 27-33 mm, about 27-35 mm, about 29-31 mm, about 29-33 mm, about 29-35 mm, about 31-33 mm, about 31-35 mm, about 33-35 mm, about 25 mm, about 27 mm, about 29 mm, about 31 mm, about 33 mm, about 35 mm).

Figure 11:
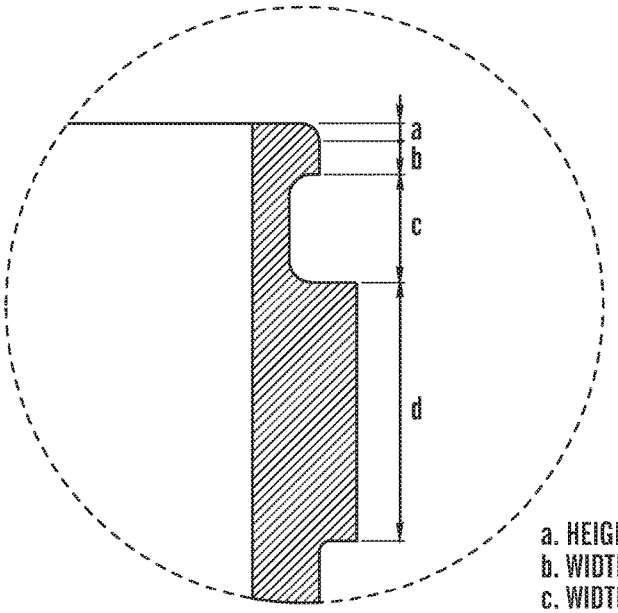
FIG. 11 is a magnified side sectional view of the upper portion of an exemplary drip-free bottle identifying the correspondence to various terms used herein.
Figure 11:
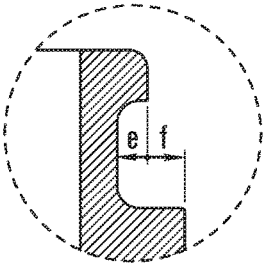
Figure 11:
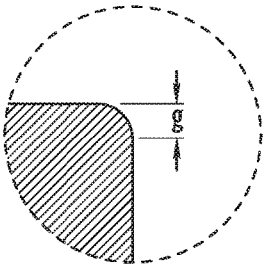

Referring more specifically to FIG. 11, this figure identifies various dimensions of the upper neck portion of the bottle and the terms used to refer to them herein.

An exemplary operation of bottle 10 will now be described with reference to FIGS. 3-11. As shown in FIG. 6A and FIG. 6B, the neck portion of bottle 10 is illustrated with an upward elevation angle (EA1) of 15 degrees representing the typical pouring angle when bottle 10 is substantially full, i.e. 80-100% full. Liquid exiting the bottle flows through the interior bore 17 of neck 16 and orifice 26 at the uppermost end of the neck 16, and then immediately over lip 24 that forms a concentric ring about orifice 26. The liquid then flows over the flow guide 22. During pouring, flow guide 22 facilitates directed flow of the liquid into a receptacle. Flow guide 22 and circumferential groove 20 together function to interrupt and break the flow of liquid when the bottle is tilted upright, while also reducing the size of droplets that can cling to the lip 24 before falling into a glass.

As shown in FIG. 6A and FIG. 6B, the uppermost depicted bottle has the largest width channel and the narrowest flow guide, resulting in the smallest residual droplet to form following pouring. This small light-weight droplet adheres well by capillary attractive forces to the narrow glass flow guide and outer edge of lip 24, and will not run down the bottle. The narrow flow guide functions well to prevent dripping, but as a narrow glass edge, it is more susceptible to chipping and breakage.

The middle depicted bottle has a medium width channel and a medium width flow guide, resulting in a small to medium sized residual droplet to form following pouring. The medium sized droplet generally clings/adheres well enough by capillary attractive forces to the medium width glass flow guide surface and outer edge of lip 24, and therefore does not cause dripping when the bottle is tilted upright following pouring. The edge of the flow guide is sufficiently robust to resist chipping or breakage under conditions of normal use.

The lowermost depicted bottle has the smallest width channel and the widest flow guide, resulting in the largest residual droplet to form following pouring. This large/heavy droplet tends to run down the bottle and produce the well known dripping problem, because the weight of the droplet exceeds its capillary attractive force to the glass flow guide surface and outer edge of lip 24. This is evident when the bottle is tilted upright following pouring.

Preferably, the capillary attractive force between the liquid (e.g., wine) and that of the glass surface of the lip and the flow guide should be as near equal as possible. This equality ensures that when the bottle is turned upright after pouring, some of the residual droplet initially residing on the flow guide will spread upward, flatten out, and stabilize on the lip surface. By comparison, if the flow guide surface is bumpy with micro-nooks and crannies (which can sometimes occur with molded glass bottles), the liquid on the flow guide can cling too strongly, and when the bottle is turned upright, gravity will pull that liquid downward into the circumferential channel, resulting in drippage. As noted above, larger droplets also tend to form as the flow guide increases in width, and the flow guide becomes less able to retain the resulting droplet. Thus, it may be desirable to alter the surface properties of the flow guide to decrease the flow guide's capillary attractive force (e.g., to wine) thereby reducing the size of the droplet that would otherwise form on an unaltered flow guide of equal width. These alterations include polishing the surface of the flow guide to remove irregularities (which tend to increase capillary adhesion) and/or adding a hydrophobic coating, such as a food grade lacquer or wax (e.g., carnauba or other wax that is edible and/or approved for direct food contact by the U.S. Food and Drug Administration or comparable government agency) to create a smooth surface. The lip tends to already be smooth after manufacture, but the lip edge could also be polished if needed. In a preferred embodiment, the glass surface of the lip and flow guide are similar in composition and surface finish (smoothness/gloss) such that the capillary attractive force between a droplet and the lip surface is equal or greater than the capillary attractive force between the droplet and the flow guide.

As illustrated and described by way of the examples herein, the technology described herein involves structural modifications to the neck portion and lip of a bottle. In particular, the modified portions of the bottle's architecture in these examples include those structural elements in the neck portion contacted by liquid during pouring or within approximately ¾ inch (more typically ½ inch) of such flowing liquid over the bottle's lip.

Further by way of example, these modifications include introducing a circumferential channel a short distance below the lip, thereby forming a flow guide between the lip and the channel. The channel is sized and positioned such that (1) the flow guide has an appropriately sized surface area such that a liquid stream exiting during pouring and a residual droplet after pouring adheres to the flow guide and outer edge of the lip and (2) there is a sufficient enough gap between the flow guide and the lower edge of the channel such that a stream of liquid poured from the bottle does not "jump" the channel during pouring.

Accordingly, this technology provides a method of enabling drip-free pouring, a drip-free bottle, and methods of making the bottle that advantageously allow for drip-free pouring, without the need for an additional insert into the bottle. Additionally, the bottle may be produced for approximately the same cost as standard bottles. Further, the bottle provides the drip-free pouring over a full range of pouring angles.

This technology relates to a glass bottle having a neck comprising: a lip extending from an inner edge defining a substantially round bottle orifice to an outer edge, wherein said lip forms a concentric ring around the bottle orifice; a flow guide extending downward from the outer edge of the lip and having an upper edge and a lower edge; a recessed circumferential channel located immediately below the flow guide, said channel having an upper edge that defines the lower edge of the flow guide and having a lower edge; an interior bore that is substantially cylindrical from at least the region containing the circumferential channel upward to the inner edge of the lip; and an optional neck collar or screw thread assembly extending outward from the neck and forming a raised band or raised screw threads around the exterior surface of the neck and located below the circumferential channel.

In one embodiment, the neck is approximately 2 to approximately 4 inches long, as measured along the center axis of the bottle.

In another embodiment, the inner edge of the lip and the outer edge of the lip have a radiused edge with a radius of curvature of about 0.5-2.5 mm and with a height of about 0.5-2 mm, as measured from the top of the radiused edge to the bottom of the radiused edge along a line parallel to the center axis of the bottle.

In another embodiment, the lip is about 2-6 mm thick, as measured along a line perpendicular to the center axis of the bottle.

In another embodiment, the lip is formed as a substantially flat horizontal surface.

In another embodiment, the lip has as a domed or convex top extending greater than 0.0 mm above the flow guide.

In another embodiment, the lip has an upward slope, as measured from the outer edge of the lip inward toward the inner edge of the lip, that is greater than zero degrees and no greater than about 30 degrees.

In another embodiment, the upward slope of the lip is 10 degrees to 30 degrees.

In another embodiment, the flow guide is about 1-3.5 mm wide, as measured from the top of the flow guide to the bottom of the flow guide along a line parallel to the center axis of the bottle.

In another embodiment, the flow guide is about 1-2 mm wide.

In another embodiment, the flow guide is coated with a food grade lacquer or wax.

In another embodiment, the flow guide is substantially free of surface irregularities.

In another embodiment, the upper edge of the channel is located about 1-3.5 mm below the outer edge of the lip.

In another embodiment, the channel is about 1-3 mm wide, as measured from the top of the channel to the bottom of the channel along a line parallel to the center axis of the bottle.

In another embodiment, the channel is about 0.75-2.5 mm deep, as measured along a line perpendicular to the center axis of the bottle.

In another embodiment, the bottom of the channel has a cross-sectional profile that is substantially cup-shaped.

In another embodiment, the bottom of the channel has a cross-sectional profile that is substantially V-shaped.

In another embodiment, the bottom of the channel has a cross-sectional profile that is substantially square-shaped.

In another embodiment, the slope of the wall forming the upper side of the channel measured at the wall's midpoint, relative to the center axis of the bottle, is about 60-90 degrees.

In another embodiment, the upper edge of the channel has a minimally radiused edge with a radius of curvature of about 0.05-0.5 mm, as measured from the top of the radiused edge to the bottom of the radiused edge along a line parallel to the center axis of the bottle.

In another embodiment, the neck collar and screw thread assembly are absent.

In another embodiment, the neck consists essentially of the lip, the flow guide, the channel, and a substantially flat region that extends from immediately below the channel to the shoulder.

In another embodiment, the neck collar and/or the screw thread assembly is present.

In another embodiment, the upper edge of the neck collar or screw thread assembly is at least about 2 mm below the outer edge of the lip.

In another embodiment, the lower edge of the channel is located no more than about 3 mm above the upper surface of the neck collar or screw thread assembly.

In another embodiment, the lower edge of the channel is contiguous with the upper surface of the neck collar or screw thread assembly.

In another embodiment, the neck collar or screw thread assembly is about 0.5-2 cm wide, as measured from the upper edge of the neck collar/screw thread assembly to the lower edge of the neck collar/screw thread assembly along the center axis of the bottle.

In another embodiment, at least one of the edges, selected from the group consisting of the inner edge of the lip, the outer edge of the lip, the lower edge of the channel, the upper edge of the neck collar if present, and the lower edge of the neck collar if present, has a radiused edge with a radius of curvature of about 0.5-2.5 mm and with a height of about 0.5-2 mm, as measured from the top of the radiused edge to the bottom of the radiused edge along a line parallel to the center axis of the bottle.

In another embodiment, the flow guide is about 1.5±0.5 mm wide, the upper surface of the channel is substantially perpendicular to the center of the axis of the bottle, the channel is at least about 0.75 mm deep, and the channel is at least about 1 mm wide.

In another embodiment, the lip has a domed or convex top extending greater than about 2 mm above the flow guide, the flow guide is about 1.5 mm wide, and the channel is about 2.5 mm wide.

In another embodiment, the ratio of (a) the height of the lip, as measured from the inner edge of the lip to the outer edge of the lip along a line parallel to the center axis of the bottle, (b) the width of the flow guide, and (c) the width of the channel, respectively, is 1.0:0.8:1.3.

In another embodiment, the bottle has a liquid capacity of between 300 ml and 1000 ml.

This technology also relates to a method for enabling drip free pouring, said method comprising: providing a glass bottle having a neck comprising (i) a lip extending from an inner edge defining a substantially round bottle orifice to an outer edge, wherein said lip forms a concentric ring around the bottle orifice; (ii) a flow guide extending downward from the outer edge of the lip and having an upper edge and a lower edge; (iii) a recessed circumferential channel located immediately below the flow guide, said channel having an upper edge that defines the lower edge of the flow guide and having a lower edge; (iv) an interior bore that is substantially cylindrical from at least the region containing the circumferential channel upward to the inner edge of the lip; and (v) an optional neck collar or screw thread assembly extending outward from the neck and forming a raised band or raised screw threads around the exterior surface of the neck and located below the circumferential channel.

In one embodiment, the neck is approximately 2 to approximately 4 inches long, as measured along the center axis of the bottle.

In another embodiment, the inner edge of the lip and the outer edge of the lip have a radiused edge with a radius of curvature of about 0.5-2.5 mm and with a height of about 0.5-2 mm, as measured from the top of the radiused edge to the bottom of the radiused edge along a line parallel to the center axis of the bottle.

In another embodiment, the lip is about 2-6 mm thick, as measured along a line perpendicular to the center axis of the bottle.

In another embodiment, the lip is formed as a substantially flat horizontal surface.

In another embodiment, the lip has as a domed or convex top extending greater than 0.0 mm above the flow guide.

In another embodiment, the lip has an upward slope, as measured from the outer edge of the lip inward toward the inner edge of the lip, that is greater than zero degrees and no greater than about 30 degrees.

In another embodiment, the upward slope of the lip is 10 degrees to 30 degrees.

In another embodiment, the flow guide is about 1-3.5 mm wide, as measured from the top of the flow guide to the bottom of the flow guide along a line parallel to the center axis of the bottle.

In another embodiment, the flow guide is about 1-2 mm wide.

In another embodiment, the flow guide is coated with a food grade lacquer or wax.

In another embodiment, the flow guide is substantially free of surface irregularities.

In another embodiment, the upper edge of the channel is located about 1-3.5 mm below the outer edge of the lip.

In another embodiment, the channel is about 1-3 mm wide, as measured from the top of the channel to the bottom of the channel along a line parallel to the center axis of the bottle.

In another embodiment, the channel is about 0.75-2.5 mm deep, as measured along a line perpendicular to the center axis of the bottle.

In another embodiment, the bottom of the channel has a cross-sectional profile that is substantially cup-shaped.

In another embodiment, the bottom of the channel has a cross-sectional profile that is substantially V-shaped.

In another embodiment, the bottom of the channel has a cross-sectional profile that is substantially square-shaped.

In another embodiment, the slope of the wall forming the upper side of the channel measured at the wall's midpoint, relative to the center axis of the bottle, is about 60-90 degrees.

In another embodiment, the upper edge of the channel has a minimally radiused edge with a radius of curvature of about 0.05-0.5 mm, as measured from the top of the radiused edge to the bottom of the radiused edge along a line parallel to the center axis of the bottle.

In another embodiment, the neck collar and screw thread assembly are absent.

In another embodiment, the neck consists essentially of the lip, the flow guide, the channel, and a substantially flat region that extends from immediately below the channel to the shoulder.

In another embodiment, the neck collar and/or the screw thread assembly is present.

In another embodiment, the upper edge of the neck collar or screw thread assembly is at least about 2 mm below the outer edge of the lip.

In another embodiment, the lower edge of the channel is located no more than about 3 mm above the upper surface of the neck collar or screw thread assembly.

In another embodiment, the lower edge of the channel is contiguous with the upper surface of the neck collar or screw thread assembly.

In another embodiment, the neck collar or screw thread assembly is about 0.5-2 cm wide, as measured from the upper edge of the neck collar/screw thread assembly to the lower edge of the neck collar/screw thread assembly along the center axis of the bottle.

In another embodiment, at least one of the edges, selected from the group consisting of the inner edge of the lip, the outer edge of the lip, the lower edge of the channel, the upper edge of the neck collar if present, and the lower edge of the neck collar if present, has a radiused edge with a radius of curvature of about 0.5-2.5 mm and with a height of about 0.5-2 mm, as measured from the top of the radiused edge to the bottom of the radiused edge along a line parallel to the center axis of the bottle.

In another embodiment, the flow guide is about 1.5±0.5 mm wide, the upper surface of the channel is substantially perpendicular to the center of the axis of the bottle, the channel is at least about 0.75 mm deep, and the channel is at least about 1 mm wide.

In another embodiment, the lip has a domed or convex top extending greater than about 2 mm above the flow guide, the flow guide is about 1.5 mm wide, and the channel is about 2.5 mm wide.

In another embodiment, the ratio of (a) the height of the lip, as measured from the inner edge of the lip to the outer edge of the lip along a line parallel to the center axis of the bottle, (b) the width of the flow guide, and (c) the width of the channel, respectively, is 1.0:0.8:1.3.

In another embodiment, the bottle has a liquid capacity of between 300 ml and 1000 ml.

Another aspect of this technology relates to a method for making a drip-free glass bottle having a neck, said method comprising: (i) forming a lip at the upper end of the neck, said lip extending from an inner edge defining a substantially round bottle orifice to an outer edge, wherein said lip forms a concentric ring around the bottle orifice; (ii) forming a flow guide in an upper region of the neck, said flow guide extending downward from the outer edge of the lip and having an upper edge and a lower edge; (iii) forming a recessed circumferential channel in an upper region of the neck, said channel located immediately below the flow guide and said channel having an upper edge that defines the lower edge of the flow guide and having a lower edge; (iv) forming an interior bore in the neck, wherein said interior bore is substantially cylindrical from at least the region containing the circumferential channel upward to the inner edge of the lip; and (v) optionally forming a neck collar or screw thread assembly in an upper region of the neck, said neck collar or screw thread assembly extending outward from the neck and forming a raised band or raised screw threads around the exterior surface of the neck and located below the circumferential channel.

In one embodiment, the neck is approximately 2 to approximately 4 inches long, as measured along the center axis of the bottle.

In another embodiment, the inner edge of the lip and the outer edge of the lip have a radiused edge with a radius of curvature of about 0.5-2.5 mm and with a height of about 0.5-2 mm, as measured from the top of the radiused edge to the bottom of the radiused edge along a line parallel to the center axis of the bottle.

In another embodiment, the lip is about 2-6 mm thick, as measured along a line perpendicular to the center axis of the bottle.

In another embodiment, the lip is formed as a substantially flat horizontal surface.

In another embodiment, the lip has as a domed or convex top extending greater than 0.0 mm above the flow guide.

In another embodiment, the lip has an upward slope, as measured from the outer edge of the lip inward toward the inner edge of the lip, that is greater than zero degrees and no greater than about 30 degrees.

In another embodiment, the upward slope of the lip is 10 degrees to 30 degrees.

In another embodiment, the flow guide is about 1-3.5 mm wide, as measured from the top of the flow guide to the bottom of the flow guide along a line parallel to the center axis of the bottle.

In another embodiment, the flow guide is about 1-2 mm wide.

In another embodiment, the flow guide is coated with a food grade lacquer or wax.

In another embodiment, the flow guide is substantially free of surface irregularities.

In another embodiment, the upper edge of the channel is located about 1-3.5 mm below the outer edge of the lip.

In another embodiment, the channel is about 1-3 mm wide, as measured from the top of the channel to the bottom of the channel along a line parallel to the center axis of the bottle.

In another embodiment, the channel is about 0.75-2.5 mm deep, as measured along a line perpendicular to the center axis of the bottle.

In another embodiment, the bottom of the channel has a cross-sectional profile that is substantially cup-shaped.

In another embodiment, the bottom of the channel has a cross-sectional profile that is substantially V-shaped.

In another embodiment, the bottom of the channel has a cross-sectional profile that is substantially square-shaped.

In another embodiment, the slope of the wall forming the upper side of the channel measured at the wall's midpoint, relative to the center axis of the bottle, is about 60-90 degrees.

In another embodiment, the upper edge of the channel has a minimally radiused edge with a radius of curvature of about 0.05-0.5 mm, as measured from the top of the radiused edge to the bottom of the radiused edge along a line parallel to the center axis of the bottle.

In another embodiment, the neck collar and screw thread assembly are absent.

In another embodiment, the neck consists essentially of the lip, the flow guide, the channel, and a substantially flat region that extends from immediately below the channel to the shoulder.

In another embodiment, the neck collar and/or the screw thread assembly is present.

In another embodiment, the upper edge of the neck collar or screw thread assembly is at least about 2 mm below the outer edge of the lip.

In another embodiment, the lower edge of the channel is located no more than about 3 mm above the upper surface of the neck collar or screw thread assembly.

In another embodiment, the lower edge of the channel is contiguous with the upper surface of the neck collar or screw thread assembly.

In another embodiment, the neck collar or screw thread assembly is about 0.5-2 cm wide, as measured from the upper edge of the neck collar/screw thread assembly to the lower edge of the neck collar/screw thread assembly along the center axis of the bottle.

In another embodiment, at least one of the edges, selected from the group consisting of the inner edge of the lip, the outer edge of the lip, the lower edge of the channel, the upper edge of the neck collar if present, and the lower edge of the neck collar if present, has a radiused edge with a radius of curvature of about 0.5-2.5 mm and with a height of about 0.5-2 mm, as measured from the top of the radiused edge to the bottom of the radiused edge along a line parallel to the center axis of the bottle.

In another embodiment, the flow guide is about 1.5±0.5 mm wide, the upper surface of the channel is substantially perpendicular to the center of the axis of the bottle, the channel is at least about 0.75 mm deep, and the channel is at least about 1 mm wide.

In another embodiment, the lip has a domed or convex top extending greater than about 2 mm above the flow guide, the flow guide is about 1.5 mm wide, and the channel is about 2.5 mm wide.

In another embodiment, the ratio of (a) the height of the lip, as measured from the inner edge of the lip to the outer edge of the lip along a line parallel to the center axis of the bottle, (b) the width of the flow guide, and (c) the width of the channel, respectively, is 1.0:0.8:1.3.

In another embodiment, the bottle has a liquid capacity of between 300 ml and 1000 ml.

The present technology may be further illustrated by reference to the following examples.

EXAMPLES

The following examples are provided to illustrate embodiments of the present technology, but they are by no means intended to limit its scope.

Example 1—Evaluation of Possible Features to Achieve Drip-Free Pouring

Two barrier structures were initially tested for their ability to prevent drips. These included (a) a protruding circumferential bead molded onto the glass similar in width, height, and location to the channel described in Example 2 below; and (b) a thin narrow bead similar to the integral glass bead, but consisting of a hydrophobic thermoplastic band formed of PTFE or other suitable thermopolymer immobilized on the neck below the lip by heat-shrinking the band or bead into a shallow groove in the glass.

The integral glass bead (a) failed to block wine dripping, because the hydrophilic nature of the glass bead permitted wine droplets to adhere and creep over this barrier. On the other hand, the thin narrow heat-shrink PTFE band (b) was effective in blocking downward migration of droplets and streams of poured wine, but the PTFE band was prone to accidental movement or loss from the bottle. Unexpectedly, in the absence of the PTFE band, the recessed groove (originally formed in the glass to receive and retain the PTFE band) was found to be able to consistently block downward migration of wine droplets and streams of poured wine.

Example 2—Fabrication and Testing of Drip Function

In order to test drip function, glass wine bottles were crafted by mechanically grinding a circumferential channel into the neck of commercial thick-walled conventional glass, dome-topped wine bottles. Seven commercial glass wine bottles (three 750 ml "Semeru" Burgundy style bottles and two each of 750 ml "Queva" Burgundy and "Jaonli" Bordeau style bottles) were obtained from M.A. Silva USA Inc. (Santa Rosa, Calif.) (see www.masilva.com/#glassCatalog). Each bottle was mounted horizontally and secured in a motorized device that rotated the bottle slowly. The neck finishes of these bottles were modified by grinding a channel into each neck using a variety of diameters of rapidly rotated diamond grinding bits on slowly rotated bottles. Ground glass surfaces were subsequently polished until smooth and glossy (finished with white rouge polishing compound) to replicate the surface of a glass bottle made from a mold or alternatively coated with a clear nitrocellulose-based lacquer nail polish or a food grade wax (e.g., carnauba wax) to approximate a glass surface.

All channels were 1 mm deep, rounded-bottom (cup-shaped) channels. The channels were positioned a small distance below the lip of the bottle and immediately above the upper edge of the neck collar. These channels create a flow guide onto which a single wine droplet almost invariably clings following normal pouring of wine.

First, the width of the channels was varied to test the effect that the size of the channel and resulting flow guide would have on droplet formation and dripping using the three "Semeru" Burgundy style bottles. In all bottles tested, the absolute position of the neck collar and the upper edge of the flow guide remained constant (see FIG. 6A and FIG. 6B). The size of the flow guide was controlled by altering the position and width of the channel. Two features relative to the size/position of the channel and flow guide were tested.

(a) Width of the flow guide (i.e., distance from the upper edge of the flow guide to the lower edge of the flow guide/upper edge of the channel); and (b) Width of the channel (i.e., distance from the upper edge of the channel to the lower edge of the channel/upper edge of the neck collar).

TABLE 1

| "Semeru" Burgundy Style Bottles | | | | |
|---|---|---|---|---|
| Bottle Number | 1 (control) | 2 | 3 | 4 |
| Flow Guide Width | [continuous from the lip to the neck collar] | ~1 mm | ~2 mm | ~3 mm |
| Channel Width | None | ~3 mm | ~2 mm | ~1 mm |

Wine was repeatedly poured from each of the bottles with their neck finishes modified as described above. The extent to which each fully filled wine bottle (containing 750 ml wine) experienced dripping during wine pouring was monitored.

The "control bottle" (unmodified Bottle #1) showed extensive and repeated dripping as wine coated the lower surface of the bottle from the lip and/or neck collar downward to the heel of the bottle during nearly each pouring.

Bottle 2 had the largest width channel and the narrowest flow guide. Forming a channel this short a distance below the lip's outer edge effectively created an outer bead-shaped (or ring-shaped) flow guide. The bead-like flow guide structure assumed the role of the traditional outer pouring edge of a bottle. Wine droplets cleanly fell into a wine glass from this bead-like lip. The narrowest residual droplet formed, which adhered to the surface of the flow guide when the bottle was tilted upright after pouring. However, the narrowness of the flow guide makes this bottle more susceptible to chipping and breakage.

Bottle 3 had a medium width channel and a medium width flow guide. The medium-sized flow guide produced a medium-sized residual droplet. As with Bottle 2, the droplet was small enough relative to the surface area of the flow guide to adhere to the flow guide after pouring rather than dripping down the neck. The larger flow guide of Bottle 3 was also less prone to chipping/breaking than that of Bottle 2. The width of the channel was also sufficient to prevent the stream of liquid from "jumping" the gap created by the channel.

Bottle 4 had the smallest width channel and the widest flow guide. The substantially wider flow guide resulted in much larger residual wine droplets on the flow guide after pouring. The larger, heavier wine droplets were prone to dripping down the bottle when the bottle was tilted upright following pouring. The narrowness of the channel also had a tendency to permit the stream of liquid to "jump" the gap created by the channel and flow from the flow guide to the neck collar and from thence down the side of the bottle.

Next, using the same process as described above for the "Semeru" bottles, two each of the "Queva" and "Jaonli" bottles were modified by introducing a 1.5 mm wide/1 mm deep channel, resulting in a 2.5 mm wide flow guide. Wine was poured from these bottles as described above. Similar to Bottle 3 of the "Semeru" style, good droplet adhesion and drip prevention were observed and the flow guide was sufficiently wide to provide good resistance against chipping and breakage.

Example 3—Droplet Size

The size of a droplet formed on a 750 ml Bordeaux style bottle modified to have a dome-shaped (2 mm tall) lip surface, a flow guide (1.5 mm wide), and channel (2.5 mm wide and 1 mm deep) was tested after pouring a glass of wine and tilting the bottle upright. With this bottle architecture, the average weight of the residual wine droplet (quantitated by blotting with absorbent swatches of paper towel) was 18±2 microliters based on 15 successive pours of dry French Bordeaux.

After pouring a dry red wine from a typical conventional wine bottle (made from soda lime glass), the volume of residual wine remaining on a bottle's uppermost lip portion may vary, but is typically at least approximately 15-30 microliters. Forces of surface tension and gravity, as well as attractive capillary forces between glass and wine, cause the residual wine on the bottle's lip to form a flattened droplet that elongates and drips down the outside of the bottle's neck. However, if a slender flow guide (e.g., approximately 1.5 mm wide) together with a circumferential channel as described herein have been integrated into a bottle (e.g., a "Jaonli" Bordeaux style wine bottle) containing a dry red wine being poured, then approximately 18±3 microliters of residual wine remains on the bottle's lip and tends to form a somewhat flattened rounded droplet that moves into a stable position contacting both the outer edge of the bottle's lip and the flow guide. At that position, the droplet remains stationary without further descent into the circumferential channel. In other words, the droplet appears balanced by capillary adhesive forces to both the outer edge of the lip and the surface of the flow guide immediately below the lip edge. With regard to droplet and bottle geometries and capillary forces, for a 20 microliter spherical wine droplet having a theoretical diameter of approximately 3.4 mm, when that droplet moves downward 1.5 mm over the flow guide as far as the upper edge of the circumferential channel, over half of the droplet's volume and weight may still remain up on the lip edge, helping to anchor the droplet. Remarkably, with repeated testing, a bottle having the above described dimensions consistently retains a residual wine droplet on the bottle's lip and flow guide by capillary attractive forces, thereby preventing any downward dripping over the neck of the bottle. To record the effect on the dynamics of wine flow, slow motion video was taken of dry French red wine being poured from a modified and an unmodified Jaonli bottle (see www.brandeis.edu/now/2017/march/wine-bottle-perlman.html).

A wine bottle with a flow guide that has been significantly broadened, e.g., above 2.5-3 mm wide flow guide, fails to perform as well as a bottle with a 1.5 mm wide flow guide, because more than half of the droplet rapidly moves downward over the wider flow guide and may then enter the circumferential channel. The dripping is prevented over a full range of pouring angles, which vary depending on the amount of liquid held in the bottle.

These experiments demonstrate that the size and weight of wine droplets falling from the bead-like lip corresponds closely to the size, i.e., width of the flow guide. A substantially wider flow guide resulted in larger wine droplets on the flow guide after pouring and a lesser ability of the outer edge of the lip to participate and sustain contact with the droplets. The larger heavier wine droplets were prone to overcoming capillary attractive forces with the glass surfaces and dripping down the bottle when the bottle was tilted upright following pouring. Conversely, a narrow flow guide produced a smaller and lighter weight clinging wine droplet that had little susceptibility to dripping when the bottle was tilted upright after pouring.

Example 4—Bar Top Bottle

The effect of introducing a channel into a bar top style neck finish was tested using a 750 ml Marsala wine bottle (Florio brand Marsala Fine Dry wine). This style bottle is sealed with a cork having a T-shaped cross-section that allows easy and convenient hand-twist removal whenever needed. With this bar top finish, the uppermost 10 mm portion of the bottle's neck finish (extending right up to the bottle's flat lip surface) is formed as a widened cylindrical collar. The neck wall thickness in the cylindrical collar portion is approximately 4.8 mm.

A circumferential channel 1.5 mm wide and 1.0 mm deep was milled in the cylindrical collar wall approximately 1.5 mm downward from the lip edge. Being 1.5 mm wide, the circumferential channel occupied a location between 1.5 mm and 3.0 mm downward from the lip edge.

When tested and challenged using dry red wine, this bar top bottle architecture prevented any wine drip 100% of the time regardless of whether wine was poured from a full, half-full, or nearly empty bottle. Based on ten wine pours, the average weight of the wine droplet remaining on the lip after each pour was 18.7±2 mg. When the bottle was tilted upright after each wine pour, the residual wine droplet initially at the lip edge moved away from that edge and onto the flat surface of the lip rather than moving downward along the 1.5 mm flow guide and into the circumferential channel.

While not wishing to be bound by theory, it is likely that the capillary adhesive force between the wine and the wide flat lip was greater than between the wine and the narrower flow guide. If so, the net force on the droplet is able to draw the wine away from the flow guide and onto the flat lip surface, where it is stabilized against dripping.

Example 5—Comparison to Lip Bead Bottles

Figure 12:
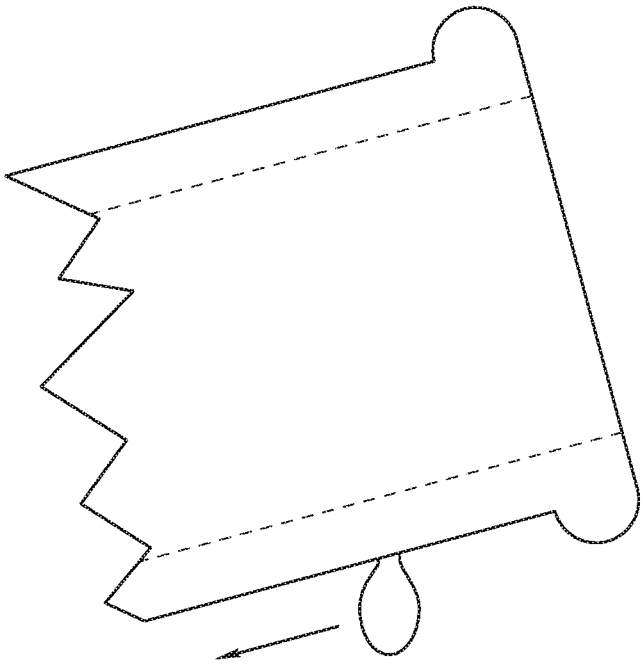
FIG. 12 PRIOR ART
FIG. 12 is a magnified view of the end of a standard bottle molded with a circumferential glass lip bead in which the neck is oriented with a 15 degree angle of elevation and in which a liquid droplet is moving downward along the neck during or after pouring.

A number of glass beverage bottles, including beer bottles (with crimped metal caps) and sherry bottles (with hand twist-removable corks) are molded with a circumferential glass bead (aka, "lip bead") that forms the pouring lip of the bottle, as shown in FIG. 12. To a significant extent, the lip bead guides a stream of poured beverage from the lip downward into a wine glass or other vessel. Bottles such as these were examined to see whether the lip bead produced a drip-free bottle. In numerous tests such lip beads failed to provide drip-free pouring.

Compared with the bottles of the present technology, whose lip and flow guide structure retains a wine droplet (dry red wine) of typically about 18 mg±2 mg, lip bead bottles were found to retain wine droplets that are substantially larger/heavier and exhibit greater statistical variability in weight. Based on 15 measurements, a typical sherry bottle retained wine droplets weighing an average of 26±4 mg. These larger/heavier wine droplets were more susceptible to dripping down the sidewall of the bottle, where increased droplet weight exceeds the droplet's capillary adhesion to the glass.

Example 6—Hydrophobic Coating

To evaluate the effect of applying a hydrophobic coating, carnauba coatings were applied to portions of wine bottle neck finishes by heating the bottle's neck finish until the glass surface temperature exceeded the melting temperature of the wax (approximately 85° C.). A crayon-like stick of 100% carnauba wax was then used to apply the wax to each relevant glass surface or surfaces of the bottle's neck finish, as follows.

To standard glass wine bottles having a neck finish like that depicted in FIGS. 1A-2B, a carnauba wax coating was applied to (a) the uppermost lip surface (surrounding the orifice), (b) the vertical pouring edge (between the lip surface and the neck collar), or (c) both the lip and the pouring edge. In all cases, the coating consistently failed to prevent wine dripping.

A carnauba wax coating was also applied to glass wine bottles having a neck finish architecture similar to that shown in the center panel of FIG. 6A (but whose 1.5 mm wide flow guide 22 was covered with surface irregularities). The wax coating was applied after heating the neck finish to a temperature above the wax's melting point to either: (a) the lip surface 24, (c) the lip surface and the flow guide 22, or (b) the flow guide alone. When wax was applied to the lip surface alone, the bottle was prone to dripping. When wax was applied to the lip surface and the flow guide, the bottle was considerably less prone to dripping.

However, when wax was applied to the flow guide alone, the bottle did not drip at all. Remarkably, in the latter case the omnipresent residual wine droplet residing at the juncture of the lip and the flow guide immediately after pouring tended to retract backward and slightly upward onto the lip surface as the bottle was tilted upright after pouring. That residual droplet was observed to thin, spread out, and stabilize on the lip surface by capillary adhesion made possible only because the lip surface had not been coated with wax. Without being bound by theory, it is believed that this latter observation is due to the selective repulsion of the wine droplet by the wax-coated flow guide.

Shellac was also tested as a possible coating for improving the performance of the flow guide. A dry red wine was poured from a bottle in which half the circumference had a flow guide that was coated with carnauba wax and the other half was coated with shellac. The carnauba wax-coated half was entirely drip-free, but the shellac-coated half allowed wine drippage. The difference is attributable to the shellac forming a substantially hydrophilic coating on the glass, which was apparent from the dry red wine easily wetting the shellac coating. Carnauba wax (and presumably other waxes), on the other hand, is very hydrophobic, which was apparent from the carnauba coating repelling the wine.

These results and others demonstrate that wax and similar hydrophobic coatings are not useful for preventing wine drips with conventional wine bottles, but can be useful for improving the performance of some bottles having a flow guide and channel as described herein, by making the flow guide more hydrophobic. This would be particularly useful when the surface of the flow guide is somewhat hydrophilic, for example due to the presence of surface irregularities (e.g., a flow guide surface that is micro-bumpy rather than smooth).

Having thus described the basic concept of the technology, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the technology. Accordingly, the technology is limited only by the following claims and equivalents thereto.

What is claimed is:

1. A glass bottle having a neck terminating in a shoulder, said neck comprising:

a lip extending from an inner edge defining a substantially round bottle orifice to an outer edge, wherein said lip forms a concentric ring around the bottle orifice;

a flow guide extending downward from the outer edge of the lip and having an upper edge and a lower edge, wherein the flow guide is substantially flat and extends downward from the outer edge of the lip in a line parallel to the center axis of the bottle and wherein the flow guide is about 1-3.5 mm wide, as measured from the top of the flow guide to the bottom of the flow guide along a line parallel to the center axis of the bottle;

a recessed circumferential channel located immediately below the flow guide, said channel having an upper edge that defines the lower edge of the flow guide and having a lower edge, wherein the channel is about 1-3 mm wide, as measured from the top of the channel to the bottom of the channel along a line parallel to the center axis of the bottle, and the channel is about 0.75-2.5 mm deep, as measured along a line perpendicular to the center axis of the bottle;

an interior bore that is substantially cylindrical from at least the region containing the circumferential channel upward to the inner edge of the lip;

an optional neck collar extending outward from the neck and forming a raised band around the exterior surface of the neck and located below the circumferential channel; and an optional screw thread assembly extending outward from the neck and forming raised screw threads around the exterior surface of the neck and located below the circumferential channel.

2. The bottle according to claim 1, wherein the inner edge of the lip and the outer edge of the lip have a radiused edge with a radius of curvature of about 0.5-2.5 mm and with a height of about 0.5-2 mm, as measured from the top of the radiused edge to the bottom of the radiused edge along a line parallel to the center axis of the bottle.

3. The bottle according to claim 1, wherein the lip is formed as a substantially flat horizontal surface.

4. The bottle according to claim 1, wherein the lip has a domed or convex top extending greater than 0.0 mm above the flow guide.

5. The bottle according to claim 4, wherein the lip has an upward slope, as measured from the outer edge of the lip inward toward the inner edge of the lip, that is greater than zero degrees and no greater than about 30 degrees.

6. The bottle according to claim 1, wherein the flow guide is about 1-2 mm wide.

7. The bottle according to claim 1, wherein the flow guide is coated with a hydrophobic coating.

8. The bottle according to claim 1, wherein the flow guide is substantially free of surface irregularities.

9. The bottle according to claim 1, wherein the upper edge of the channel is located about 1-3.5 mm below the outer edge of the lip.

10. The bottle according to claim 1, wherein the bottom of the channel has a cross-sectional profile that is substantially cup-shaped.

11. The bottle according to claim 1, wherein the bottom of the channel has a cross-sectional profile that is substantially V-shaped.

12. The bottle according to claim 1, wherein the bottom of the channel has a cross-sectional profile that is substantially square-shaped.

13. The bottle according to claim 1, wherein the slope of the wall forming the upper side of the channel measured at the wall's midpoint, relative to the center axis of the bottle, is about 60-90 degrees.

14. The bottle according to claim 1, wherein the upper edge of the channel has a minimally radiused edge with a radius of curvature of about 0.05-0.5 mm, as measured from the top of the radiused edge to the bottom of the radiused edge along a line parallel to the center axis of the bottle.

15. The bottle according to claim 1, wherein the neck collar and screw thread assembly are absent.

16. The bottle according to claim 1, wherein the neck consists essentially of the lip, the flow guide, the channel, and a substantially flat region that extends from immediately below the channel to the shoulder.

17. The bottle according to claim 1, wherein the neck collar and/or the screw thread assembly is present.

18. The bottle according to claim 17, wherein the upper edge of the neck collar or screw thread assembly is at least about 2 mm below the outer edge of the lip.

19. The bottle according to claim 17, wherein the lower edge of the channel is located no more than about 3 mm above the upper surface of the neck collar or screw thread assembly.

20. The bottle according to claim 19, wherein the lower edge of the channel is contiguous with the upper surface of the neck collar or screw thread assembly.

21. The bottle according to claim 17, wherein the neck collar or screw thread assembly is about 0.5-2 cm wide, as measured from the upper edge of the neck collar/screw thread assembly to the lower edge of the neck collar/screw thread assembly along the center axis of the bottle.

22. The bottle according to claim 1, wherein at least one of the edges, selected from the group consisting of the inner edge of the lip, the outer edge of the lip, the lower edge of the channel, the upper edge of the neck collar if present, and the lower edge of the neck collar if present, has a radiused edge with a radius of curvature of about 0.5-2.5 mm and with a height of about 0.5-2 mm, as measured from the top of the radiused edge to the bottom of the radiused edge along a line parallel to the center axis of the bottle.

23. The bottle according to claim 1, wherein the flow guide is about 1.5±0.5 mm wide, as measured from the top of the flow guide to the bottom of the flow guide along a line parallel to the center axis of the bottle; and the upper surface of the channel is substantially perpendicular to the center of the axis of the bottle.

24. The bottle according to claim 1, wherein the lip has a domed or convex top extending greater than about 2 mm above the flow guide; the flow guide is about 1.5 mm wide, as measured from the top of the flow guide to the bottom of the flow guide along a line parallel to the center axis of the bottle; and the channel is about 2.5 mm wide, as measured from the top of the channel to the bottom of the channel along a line parallel to the center axis of the bottle.

25. The bottle according to claim 1, wherein the ratio of (a) the height of the lip, as measured from the inner edge of the lip to the outer edge of the lip along a line parallel to the center axis of the bottle, (b) the width of the flow guide, as measured from the top of the flow guide to the bottom of the flow guide along a line parallel to the center axis of the bottle, and (c) the width of the channel, as measured from the top of the channel to the bottom of the channel along a line parallel to the center axis of the bottle, is, respectively, 1.0:0.8:1.3.

26. A method for enabling drip free pouring, said method comprising:

providing a glass bottle having a neck comprising (i) a lip extending from an inner edge defining a substantially round bottle orifice to an outer edge, wherein said lip forms a concentric ring around the bottle orifice; (ii) a flow guide extending downward from the outer edge of the lip and having an upper edge and a lower edge, wherein the flow guide is substantially flat and extends downward from the outer edge of the lip in a line parallel to the center axis of the bottle and wherein the flow guide is about 1-3.5 mm wide, as measured from the top of the flow guide to the bottom of the flow guide along a line parallel to the center axis of the bottle; (iii) a recessed circumferential channel located immediately below the flow guide, said channel having an upper edge that defines the lower edge of the flow guide and having a lower edge, wherein the channel is about 1-3 mm wide, as measured from the top of the channel to the bottom of the channel along a line parallel to the center axis of the bottle, and the channel is about 0.75-2.5 mm deep, as measured along a line perpendicular to the center axis of the bottle; (iv) an interior bore that is substantially cylindrical from at least the region containing the circumferential channel upward to the inner edge of the lip; (v) an optional neck collar extending outward from the neck and forming a raised band around the exterior surface of the neck and located below the circumferential channel; and (vi) an optional screw thread assembly extending outward from the neck and forming raised screw threads around the exterior surface of the neck and located below the circumferential channel.

27. A method for making a drip-free glass bottle having a neck, said method comprising:

(i) forming a lip at the upper end of the neck, said lip extending from an inner edge defining a substantially round bottle orifice to an outer edge, wherein said lip forms a concentric ring around the bottle orifice;

(ii) forming a flow guide in an upper region of the neck, said flow guide extending downward from the outer edge of the lip and having an upper edge and a lower edge, wherein the flow guide is substantially flat and extends downward from the outer edge of the lip in a line parallel to the center axis of the bottle and wherein the flow guide is about 1-3.5 mm wide, as measured from the top of the flow guide to the bottom of the flow guide along a line parallel to the center axis of the bottle;

(iii) forming a recessed circumferential channel in an upper region of the neck, said channel located immediately below the flow guide and said channel having an upper edge that defines the lower edge of the flow guide and having a lower edge, wherein the channel is about 1-3 mm wide, as measured from the top of the channel to the bottom of the channel along a line parallel to the center axis of the bottle, and the channel is about 0.75-2.5 mm deep, as measured along a line perpendicular to the center axis of the bottle;

(iv) forming an interior bore in the neck, wherein said interior bore is substantially cylindrical from at least the region containing the circumferential channel upward to the inner edge of the lip;

(v) optionally forming a neck collar in an upper region of the neck, said neck collar extending outward from the neck and forming a raised band around the exterior surface of the neck and located below the circumferential channel; and (vi) optionally forming a screw thread assembly in an upper region of the neck, said screw thread assembly extending outward from the neck and forming raised screw threads around the exterior surface of the neck and located below the circumferential channel.

* * * * *